US009545984B2

(12) United States Patent
Okamoto

(10) Patent No.: US 9,545,984 B2
(45) Date of Patent: Jan. 17, 2017

(54) JET PROPELLED WATERCRAFT

(71) Applicant: YAMAHA HATSUDOKI KABUSHIKI KAISHA, Iwata-shi, Shizuoka (JP)

(72) Inventor: Yukitaka Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 49 days.

(21) Appl. No.: 14/814,648

(22) Filed: Jul. 31, 2015

(65) Prior Publication Data

US 2016/0039506 A1 Feb. 11, 2016

(30) Foreign Application Priority Data

Aug. 8, 2014 (JP) ..... 2014-162717

(51) Int. Cl.
*B63H 11/00* (2006.01)
*B63H 11/11* (2006.01)

(52) U.S. Cl.
CPC ..... *B63H 11/11* (2013.01)

(58) Field of Classification Search
CPC combination set(s) only.
See application file for complete search history.

(56) References Cited

U.S. PATENT DOCUMENTS 3,945,201 A * 3/1976 Entringer ..... B63H 11/11 114/144 B
4,026,235 A * 5/1977 Woodfill ..... B63H 11/11 440/41
4,542,464 A * 9/1985 Kramer ..... G05D 1/0206 114/144 RE
6,547,611 B1 * 4/2003 Boroos ..... F02B 61/045 440/41
6,652,332 B1 * 11/2003 Westhoff ..... B63H 11/11 440/41
6,743,062 B1 * 6/2004 Jones ..... B63H 25/44 440/38
8,490,558 B2 * 7/2013 Foley ..... 114/151
(Continued)

FOREIGN PATENT DOCUMENTS

JP 2014-080041 A 5/2014

OTHER PUBLICATIONS

Okamoto et al., "Jet Propelled Watercraft," U.S. Appl. No. 14/814,637, filed Jul. 31, 2015.

(Continued)

*Primary Examiner* — Jonathan L Sample
(74) *Attorney, Agent, or Firm* — Keating and Bennett, LLP

(57) ABSTRACT

A jet propelled watercraft includes a prime mover, a jet pump driven by the prime mover and jetting water from a jet port, a reverse gate changing a direction of the jet flow jetted from the jet pump, a shift actuator switching a position of the reverse gate among a plurality of shift positions, a reverse gate position detector detecting the position of the reverse gate, and a controller configured or programmed to execute a shift control of setting a target shift position of the reverse gate and controlling the shift actuator to move the reverse gate to the target shift position and execute an error judgment of judging that an error has occurred when the position detected by the reverse gate position detector differs from a control position.

18 Claims, 17 Drawing Sheets

(56) References Cited

U.S. PATENT DOCUMENTS 8,702,457 B2 * 4/2014 Minoura ..... B63H 11/11 440/41
2002/0028614 A1 * 3/2002 Simard ..... B63H 11/11 440/41
2002/0028615 A1 * 3/2002 Simard ..... B63H 11/117 440/41
2005/0009419 A1 * 1/2005 Kinoshita ..... B63H 21/22 440/87
2005/0085141 A1 * 4/2005 Motose ..... B63H 21/22 440/87
2005/0148247 A1 * 7/2005 Gai ..... G05G 7/10 440/84
2005/0273224 A1 * 12/2005 Ito ..... B63H 21/22 701/21
2007/0089654 A1 * 4/2007 Bradley ..... B63H 25/42 114/10
2007/0089660 A1 * 4/2007 Bradley ..... B63H 25/42 114/144 A
2008/0027597 A1 * 1/2008 Barrett ..... B63H 25/04 701/21
2011/0004367 A1 * 1/2011 Saunders ..... G05D 1/0206 701/23
2012/0272885 A1 * 11/2012 Foley ..... B63H 25/46 114/151
2012/0276793 A1 * 11/2012 Minoura ..... B63H 11/107 440/41
2013/0237106 A1 * 9/2013 Minoura ..... B63H 11/11 440/41
2013/0344754 A1 * 12/2013 Kinoshita ..... B63H 21/21 440/1
2014/0096505 A1 * 4/2014 Okamoto ..... B63H 11/11 60/221
2014/0099845 A1 * 4/2014 Fujino ..... B63B 35/731 440/40
2014/0102075 A1 * 4/2014 Kinoshita ..... B63H 11/11 60/221
2016/0039504 A1 * 2/2016 Okamoto ..... B63H 11/113 415/35
2016/0039505 A1 * 2/2016 Okamoto ..... B63H 11/107 440/40

OTHER PUBLICATIONS

Okamoto et al., "Jet Propelled Watercraft," U.S. Appl. No. 14/814,645, filed Jul. 31, 2015.
Kinoshita, "Small Vessel Propulsion System," U.S. Appl. No. 14/814,650, filed Jul. 31, 2015.

* cited by examiner

JET PROPELLED WATERCRAFT

BACKGROUND OF THE INVENTION

1. Field of the Invention

The present invention relates to a jet propelled watercraft.

2. Description of the Related Art

U.S. Pat. No. 6,547,611 discloses a personal watercraft that includes an engine, a jet pump driven by the engine, a reverse gate, an electric motor (shift actuator) arranged to move the reverse gate, and three limit switches arranged to detect a shift position of the reverse gate. The electric motor that is the shift actuator moves the reverse gate to a forward drive position, a neutral position, and a reverse drive position. With this personal watercraft, a rotational speed of the engine is restricted when the reverse gate is at a position other than the forward drive position.

Japanese Patent Application Publication No. 2014-80041 discloses a jet propelled watercraft that includes an engine, a jet pump driven by the engine, a reverse gate, a reverse gate moving mechanism arranged to move the reverse gate, a shift member (reverse gate operator) arranged to operate the reverse gate, and an ECU (electronic controller). The reverse gate moving mechanism moves the reverse gate between a forward drive position and a reverse drive position. The reverse gate moving mechanism includes an electric motor and a transmission mechanism arranged to transmit the motive power of the electric motor to the reverse gate. The reverse gate operator is not mechanically coupled to the reverse gate. The ECU controls the reverse gate moving mechanism (electric motor) in accordance with operation of the reverse gate operator to move the reverse gate. This jet propelled watercraft includes a function (forward drive position retracting function) by which the reverse gate is retracted to the forward drive position to enable forward drive movement when the reverse gate moving mechanism malfunctions.

SUMMARY OF THE INVENTION

The inventor of preferred embodiments of the present invention described and claimed in the present application conducted an extensive study and research regarding a jet propelled watercraft, such as the one described above, and in doing so, discovered and first recognized new unique challenges and previously unrecognized possibilities for improvements as described in greater detail below.

A case where the reverse gate position is not matched with a control position is not assumed in U.S. Pat. No. 6,547,611.

The forward drive position retracting function described in Japanese Patent Application Publication No. 2014-80041 is effective in a case where the reverse gate moving mechanism malfunctions. However, with a jet propelled watercraft with which the reverse gate is moved by an actuator, such as the electric motor, etc., as in the jet propelled watercraft according to Japanese Patent Application Publication No. 2014-80041, the reverse gate position may become unmatched with a control position even when the reverse gate moving mechanism is normal. For example, when an obstacle that obstructs movement of the reverse gate when it is moving is jammed or when the reverse gate position deviates due to an external force, the reverse gate position and the control position become unmatched even though the reverse gate moving mechanism is normal. Also with such a jet propelled watercraft, the reverse gate operator is not coupled to the reverse gate mechanically and an operator is thus unlikely to notice that the reverse gate position and the control position are unmatched.

In order to overcome the previously unrecognized and unsolved challenges described above, a preferred embodiment of the present invention provides a jet propelled watercraft including a body, a prime mover, a jet pump driven by the prime mover and jetting water from a jet port, a reverse gate changing a direction of the jet flow jetted from the jet pump, a shift actuator switching a position of the reverse gate among a plurality of shift positions, a reverse gate position detector detecting the position of the reverse gate, and a controller. The plurality of shift positions include a forward drive position, at which the direction of the jet flow is toward the rear of the body, a reverse drive position, at which the direction of the jet flow is toward the front of the body, and a predetermined neutral position between the forward and reverse drive positions. The controller is configured or programmed to execute a shift control of setting a target shift position of the reverse gate and controlling the shift actuator to move the reverse gate to the target shift position and execute an error judgment of judging that an error has occurred when the position detected by the reverse gate position detector differs from a control position.

With this arrangement, when the reverse gate position differs from the control position, it is judged that an error has occurred. Appropriate control is thus performed when the reverse gate position differs from the control position.

In a preferred embodiment of the present invention, the controller is configured or programmed to execute a movement error process of controlling the shift actuator to stop the movement of the reverse gate by the shift control and move the reverse gate in a direction opposite to a direction of movement of the reverse gate before stoppage when it judges that the error has occurred during driving of the shift actuator by the shift control to move the reverse gate.

With this arrangement, if an obstacle that obstructs the movement of the reverse gate is present when the shift actuator is being driven, the movement of the reverse gate is stopped. Also, the reverse gate is moved in the direction opposite to the movement direction of the reverse gate before stoppage. The obstacle is thus released to resolve the error.

In a preferred embodiment of the present invention, the controller is configured or programmed to execute a movement error process of controlling the shift actuator to stop the movement of the reverse gate by the shift control and move the reverse gate to a position immediately before being moved by the shift control when it judges that the error has occurred during driving of the shift actuator by the shift control to move the reverse gate.

With this arrangement, if an obstacle that obstructs the movement of the reverse gate is present when the shift actuator is being driven, the movement of the reverse gate is stopped. Also, the reverse gate is moved to the position immediately before being moved by the shift control. The obstacle is thus released to resolve the error.

In a preferred embodiment of the present invention, the controller is configured or programmed to judge whether or not the error has occurred based on a movement amount of the reverse gate per unit time during driving of the shift actuator by the shift control to move the reverse gate.

With this arrangement, if an obstacle that obstructs the movement of the reverse gate is present when the shift actuator is being driven, it is judged that the error has occurred.

In a preferred embodiment of the present invention, the shift actuator is an electric shift actuator and the controller is configured or programmed to judge whether or not the error has occurred based on an electric current flowing through the electric actuator during driving of the electric actuator by the shift control to move the reverse gate.

With this arrangement, if an obstacle that obstructs the movement of the reverse gate is present when the shift actuator is being driven, it is judged that the error has occurred.

In a preferred embodiment of the present invention, the controller is configured or programmed so that after the movement error process has been started, movement of the reverse gate by the shift control is prohibited until a power supply of the controller is turned off.

With this arrangement, the shift control is disabled when the reverse gate is being moved by the movement error process. Interference of the movement error process by the shift control is thus avoided and the reverse gate is prevented from being moved in the direction opposite to the movement direction under the movement error process.

A preferred embodiment of the present invention further includes a display and the controller is configured or programmed to make error occurrence be displayed on the display when it judges that the error has occurred during driving of the shift actuator by the shift control to move the reverse gate. With this arrangement, an operator is notified of the occurrence of error.

A preferred embodiment of the present invention further includes a storage or memory storing a most recent target shift position and the controller is configured or programmed to judge that the error has occurred if, when the shift actuator is not being driven by the shift control to move the reverse gate, the position detected by the reverse gate position detector differs from the target shift position stored in the storage or memory.

With this arrangement, if the reverse gate is made to deviate from the target shift position by an external force, etc., when the shift actuator is not being driven, it is judged that the error has occurred.

In a preferred embodiment of the present invention, the controller is configured or programmed to execute a keep error process of controlling the shift actuator to move the reverse gate to the target shift position stored in the storage or memory if it judges that the error has occurred when the shift actuator is not being driven by the shift control to move the reverse gate.

With this arrangement, if the reverse gate is made to deviate from the target shift position by an external force, etc., when the shift actuator is not being driven, the reverse gate is moved so as to return to the target shift position.

A preferred embodiment of the present invention further includes a display and the controller is configured or programmed so as not to make error occurrence be displayed on the display if it judges that the error has occurred when the shift actuator is not being driven by the shift control to move the reverse gate. A positional deviation of the reverse gate due to an external force, etc., is recovered automatically and therefore notification thereof as an error to a user is of no benefit. Therefore in such a case, it is more appropriate not to perform display of error occurrence.

In a preferred embodiment of the present invention, the controller is configured or programmed so that if the target shift position is changed while the keep error process is being executed, it cancels the keep error process and causes the reverse gate to be moved by the shift control to the target shift position after the change.

With this arrangement, if the target shift position is changed while the keep error process is being executed, the reverse gate is moved promptly to the target shift position after the change.

In a preferred embodiment of the present invention, the controller is configured or programmed to execute a malfunction determination of determining whether or not a malfunction has occurred in the reverse gate position detector or the shift actuator and to perform the error judgment when it determines that a malfunction is not occurring in the reverse gate position detector or the shift actuator.

With this arrangement, the error judgment is performed when a malfunction is not occurring in the reverse gate position detector or the shift actuator.

In a preferred embodiment of the present invention, the controller is configured or programmed to execute a malfunction determination of determining whether or not a malfunction has occurred in the reverse gate position detector or the shift actuator and so as not to perform the error judgment when it determines that a malfunction has occurred in the reverse gate position detector or the shift actuator.

With this arrangement, the error judgment is not performed when a malfunction is occurring in the reverse gate position detector or the shift actuator. An uncertain error judgment is thus avoided.

In a preferred embodiment of the present invention, the controller is configured or programmed to control the shift actuator to move the reverse gate to the forward drive position when it determines that a malfunction has occurred in the reverse gate position detector. With this arrangement, control is performed to enter a state enabling generation of a propulsive force in the forward drive direction when a malfunction has occurred in the reverse gate position detector. The jet propelled watercraft is thus driven forward and made to return to port reliably.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
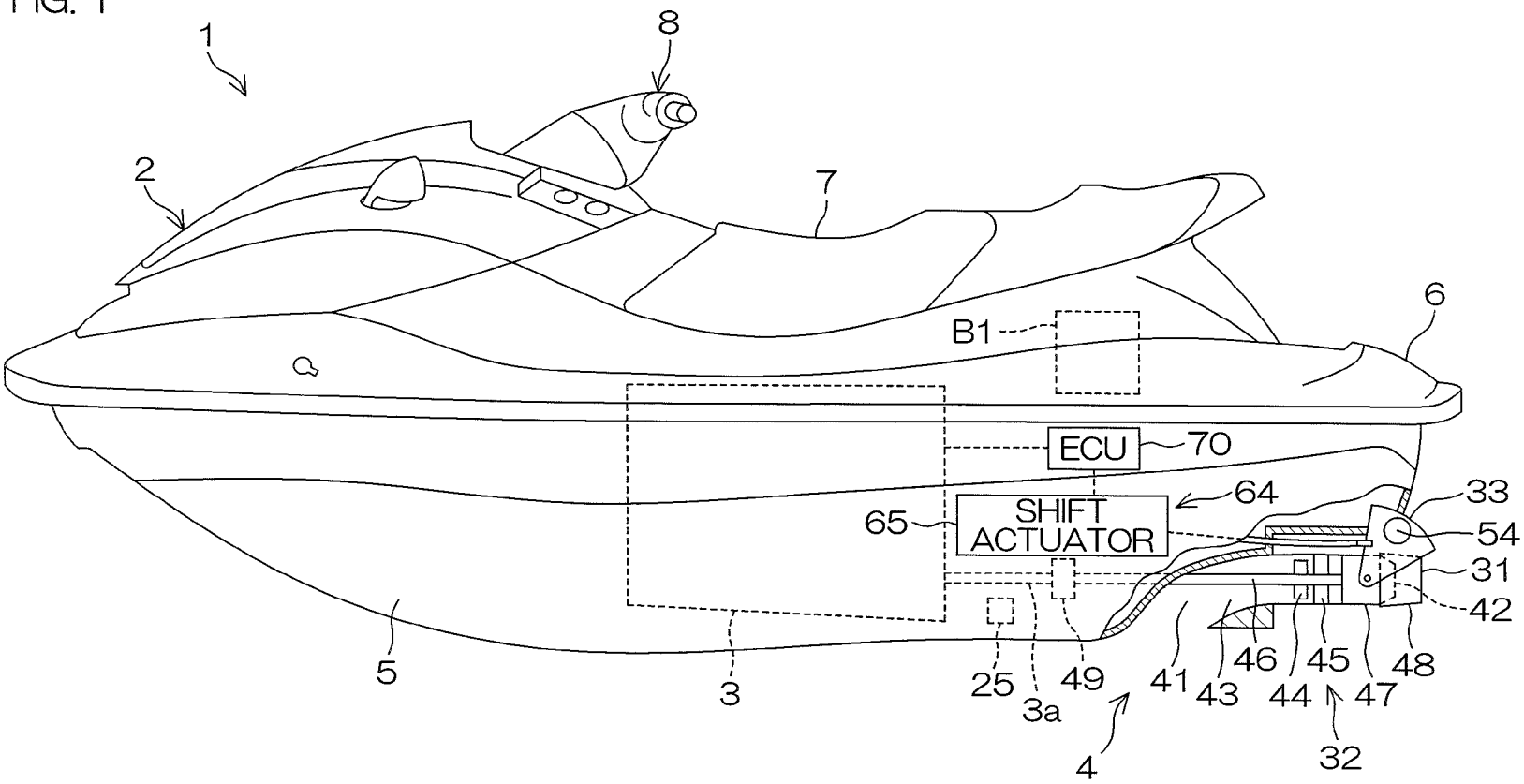
FIG. 1 is a schematic view of a jet propelled watercraft according to a preferred embodiment of the present invention.

FIG. 1 is a schematic view of a jet propelled watercraft according to a preferred embodiment of the present invention. The jet propelled watercraft 1 is a small vessel used to travel on a body of water, such as a lake or sea, etc. The jet propelled watercraft 1 according to the present preferred embodiment is a personal watercraft (PWC), for example.

The jet propelled watercraft 1 includes a body 2, an engine 3 as a prime mover disposed in an interior of the body 2, and a jet propulsion device 4 mounted on a rear portion of the body 2. The engine 3 and the jet propulsion device 4 constitute a propulsion generator that applies a propulsive force to the body 2.

The body 2 includes a hull 5 that defines a watercraft bottom and a deck 6 disposed above the hull 5. The engine 3 is disposed in a space defined between the hull 5 and the deck 6. Further in the space is disposed a battery B1 that supplies electric power to electrical equipment included in the jet propelled watercraft 1. The engine 3 is disposed in front of the jet propulsion device 4.

The engine 3 is an internal combustion engine that includes a crankshaft 3*a* rotatable around a rotation axis extending in a front/rear direction. The engine 3 includes an engine speed sensor 25 configured to detect a rotational speed of the engine 3. The jet propulsion device 4 is driven by the engine 3. The jet propulsion device 4 jets water, sucked into a watercraft interior (into the interior of the body 2) from the watercraft bottom, to a watercraft exterior (exterior of the body 2) to generate the propulsive force to propel the jet propelled watercraft 1 forward or in reverse.

A seat 7, on which an operator sits, is disposed on the deck 6. The seat 7 is disposed above the engine 3. The seat 7 is disposed at a center in a width direction of the jet propelled watercraft 1. A handle 8 is disposed in front of the seat 7. The handle 8 is an operating member operated by the operator to change a direction of the body 2.

Figure 2:
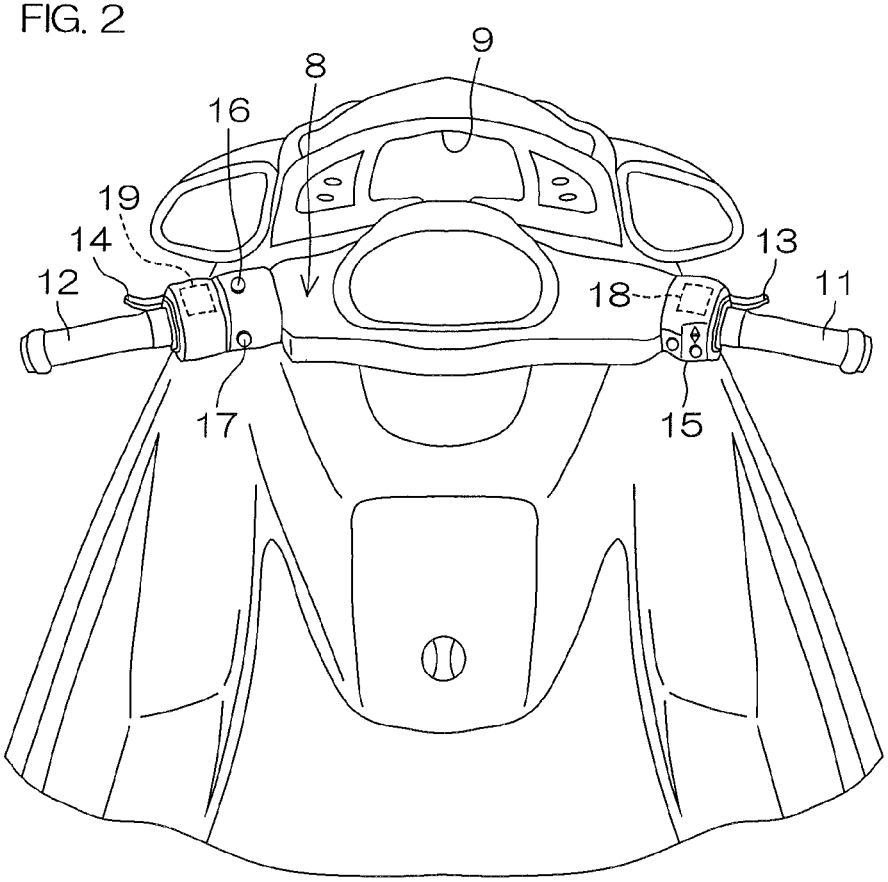
FIG. 2 is a perspective view of the arrangement of a vicinity of a handle of the jet propelled watercraft.

FIG. 2 is a perspective view of the arrangement of a vicinity of the handle 8. A display 9 is disposed in front of the handle 8. The handle 8 includes a right grip 11 and a left grip 12. A first accelerator operator (accelerator operator) 13 is rotatably mounted on the right grip 11. A second accelerator operator (reverse gate operator) 14 is rotatably mounted on the left grip 12. On the handle 8, an operation box 15 is mounted at an inner side of the right grip 11. A start switch 16 to start the engine and a stop switch 17 to stop the engine are provided at an inner side of the left grip 12 of the handle 8.

The first accelerator operator 13 is mainly operated to drive the jet propelled watercraft 1 forward. In the present preferred embodiment, the first accelerator operator 13 preferably is a lever type that includes an accelerator lever. An amount of operation of the first accelerator operator 13 (operation angle of the accelerator lever; hereinafter referred to as the "first accelerator operation amount Am1") is detected by a first accelerator position sensor 18. The first accelerator position sensor 18 is, for example, a potentiometer. The first accelerator position sensor 18 is an example of an accelerator operation detector that detects an operation state of the first accelerator operator 13.

The second accelerator operator 14 is mainly operated to drive the jet propelled watercraft 1 in reverse or to reduce a forward speed of the jet propelled watercraft 1. In the present preferred embodiment, the second accelerator operator 14 preferably is a lever type that includes a reverse lever. An amount of operation of the second accelerator operator 14 (operation angle of the reverse lever; hereinafter referred to as the "second accelerator operation amount Am2") is detected by a second accelerator position sensor 19. The second accelerator position sensor 19 is, for example, a potentiometer. The second accelerator position sensor 19 is an example of a reverse gate operation detector that detects an operation state of the second accelerator operator 14.

Figure 3:
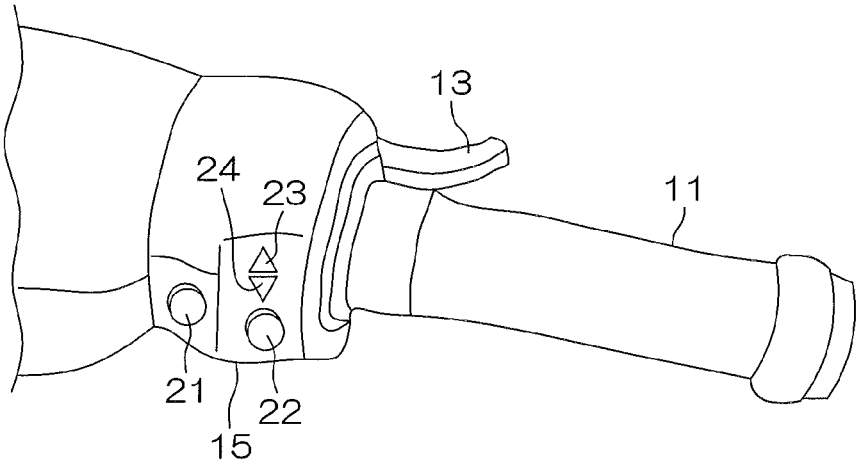
FIG. 3 is an enlarged perspective view of the arrangement of a vicinity of a right grip of the handle.

FIG. 3 is an enlarged perspective view of the arrangement of a vicinity of the right grip of the handle. A low-speed travel mode switch 21, a constant-speed travel mode switch 22, an acceleration fine adjustment switch 23, and a deceleration fine adjustment switch 24 are provided in the operation box 15. The switches 21 to 24 are disposed in a region enabling operation with a right thumb of the operator in a state where he/she holds the right grip 11 with the right hand.

The jet propelled watercraft 1 is made to travel in any of a plurality of travel modes. The plurality of travel modes include an ordinary travel mode, a low-speed travel mode, and a constant-speed travel mode, for example. The ordinary travel mode is a travel mode (first mode) in which the jet propelled watercraft 1 travels at a speed that is in accordance with operations of the first accelerator operator 13 and the second accelerator operator 14. The low-speed travel mode is a mode (second mode) in which the jet propelled watercraft 1 travels at a predetermined low speed. The constant-speed travel mode is a mode in which the jet propelled watercraft 1 travels at the speed at the point at which the constant-speed travel mode switch 22 is operated.

The low-speed travel mode switch 21 is a switch configured to set the travel mode to the low-speed travel mode and is an example of a mode switching signal output that outputs a mode switching signal to switch from the ordinary travel mode to the low-speed travel mode. The fine adjustment switches 23 and 24 are switches configured to finely adjust the speed of the jet propelled watercraft 1 in the low-speed travel mode. The constant-speed travel mode switch 22 is a switch configured to set the travel mode to the constant-speed travel mode.

As shown in FIG. 1, the jet propulsion device 4 includes a jet pump 32, by which water of the watercraft exterior that is sucked in from the watercraft bottom is jetted rearward, and a reverse gate 33, which changes a direction of a jet flow jetted from the jet pump 32.

The jet pump 32 includes an intake 41 through which the watercraft exterior water is sucked in, an outlet 42 from which the water sucked in from the intake 41 is jetted rearward, and a flow passage 43 guiding the water sucked into the intake 41 to the outlet 42. The jet pump 32 further includes an impeller 44 (rotor vane) and a stator vane 45 that are disposed in the flow passage 43, a driveshaft 46 coupled to the impeller 44, a nozzle 47 defining the outlet 42, and a deflector 48 inclining the direction of the jet flow, jetted rearward from the nozzle 47, to the right and left.

The intake 41 is opened at the watercraft bottom and the outlet 42 is opened rearward further to the rear than the intake 41. The driveshaft 46 extends in the front/rear direction. A front end portion of the driveshaft 46 is disposed inside the watercraft and a rear end portion of the driveshaft 46 is disposed in the flow passage 43. The front end portion of the driveshaft 46 is coupled to the crankshaft 3*a* of the engine 3 via a coupling 49. The impeller 44 is coupled to the driveshaft 46. The stator vane 45 is disposed rearward of the impeller 44. The nozzle 47 is disposed rearward of the stator vane 45. The impeller 44 is rotatable around a central axis of the driveshaft 46 with respect to the flow passage 43. The stator vane 45 is fixed with respect to the flow passage 43. The nozzle 47 is fixed to the body 2.

The engine 3 drives the impeller 44, together with the driveshaft 46, around the central axis of the driveshaft 46. When the impeller 44 is driven to rotate, water is sucked into the flow passage 43 from the intake 41 and the water sucked into the flow passage 43 is fed from the impeller 44 to the stator vane 45. By the water fed by the impeller 44 passing through the stator vane 45, torsion of water flow generated by rotation of the impeller 44 is reduced and the water flow is straightened. The flow-straightened water is thus fed from the stator vane 45 to the nozzle 47. The nozzle 47 has a tubular form extending in the front/rear direction and the outlet 42 is formed by a rear end portion of the nozzle 47. The water fed to the nozzle 47 is thus jetted rearward from the rear end portion of the nozzle 47.

Figure 4:
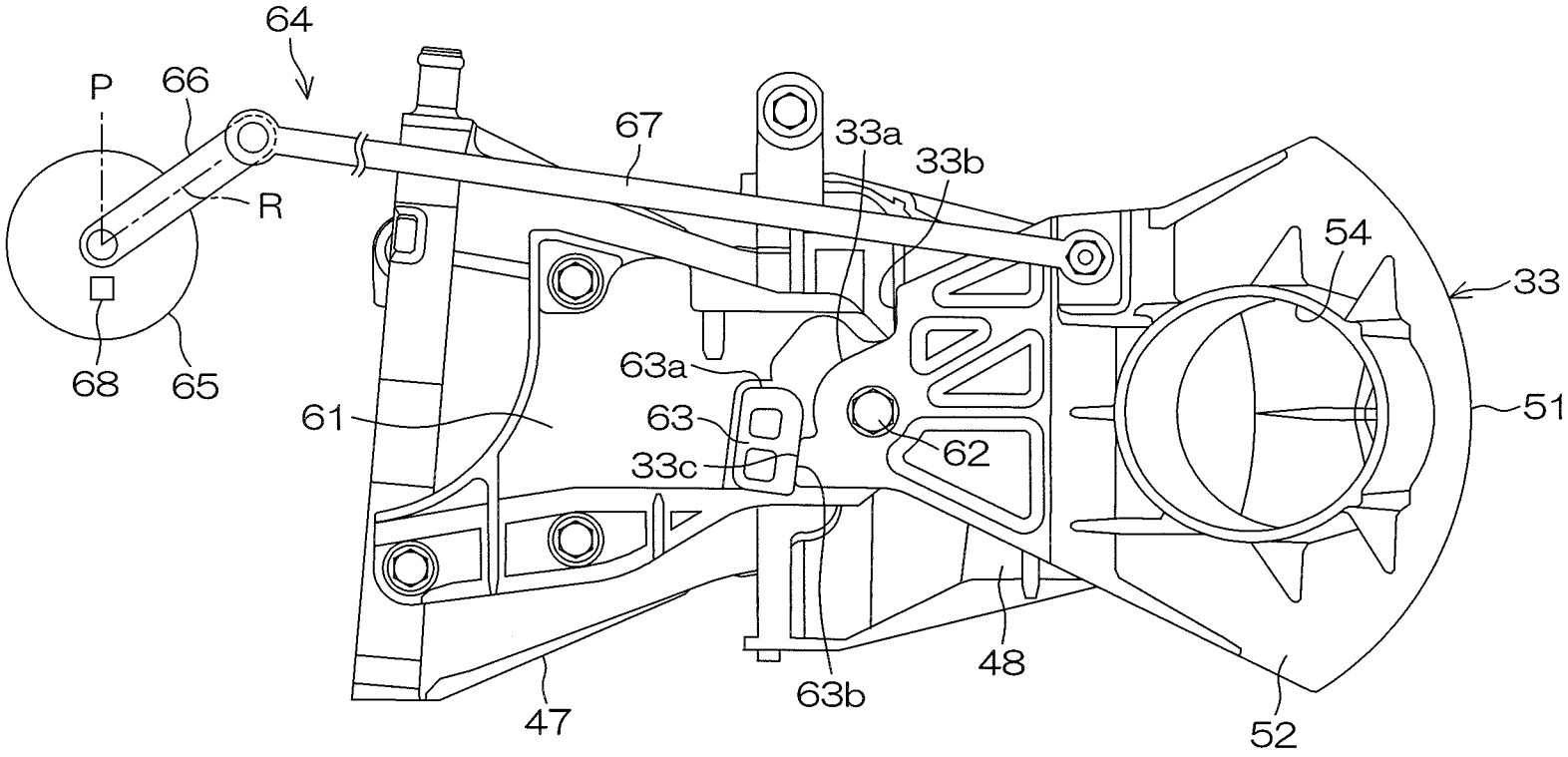
FIG. 4 is a schematic side view of the jet propelled watercraft in a state where a reverse gate is at a reverse drive position.
Figure 5:
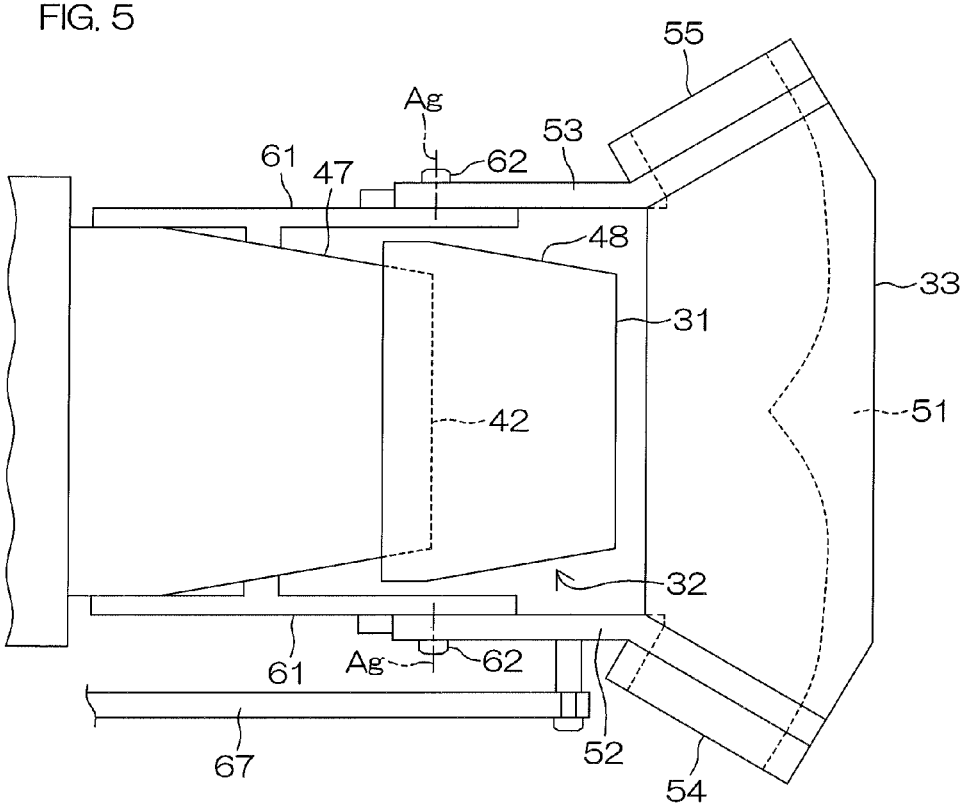
FIG. 5 is a schematic plan view of the arrangement of FIG. 4.

FIG. 4 is a schematic side view showing the arrangement of a vicinity of the nozzle 47 in enlarged manner. FIG. 5 is a schematic plan view of the arrangement of FIG. 4. The deflector 48 is disposed rearward of the nozzle 47. The deflector 48 is supported by the nozzle 47 in a manner enabling rotation in a right/left direction. The deflector 48 has a hollow tube shape. The outlet 42 of the nozzle 47 is disposed inside the deflector 48. The deflector 48 defines a jet port 31 that is opened rearward. The jet port 31 is disposed rearward of the outlet 42. The water that is jetted rearward from the nozzle 47 passes through an interior of the deflector 48 and is jetted from the jet port 31. A jetting direction of the water is in accordance with a right/left direction angle of the deflector 48.

The reverse gate 33 is supported by the nozzle 47 in a manner enabling rotation around an up/down rotation axis Ag extending in the right/left direction. For the sake of description, in the following, front, rear, up, and down with respect to the reverse gate 33 shall refer to front, rear, up, and down as defined in a state where the reverse gate 33 is at the position shown in FIG. 4 and FIG. 5. The reverse gate 33 includes a rear wall 51 as an opening/closing portion that opens/closes the jet port 31 of the deflector 48, a left side wall 52 extending frontward from a left side portion of the rear wall 51, and a right side wall 53 extending frontward from a right side portion of the rear wall 51. The left side wall 52 and the right side wall 53 have fan shapes spreading toward the rear in side view. A left opening 54 that is opened obliquely forward to the left is located near a rear end of the left side wall 52. A right opening 55 that is opened obliquely forward to the right is located near a rear end of the right side wall 53. The left opening 54 and the right opening 55 are right/left symmetrical to a vertical plane passing through a right/left center of the reverse gate 33.

A pair of right and left support brackets 61 are mounted to the nozzle 47. Front end portions of the respective side walls 52 and 53 of the reverse gate 33 are supported by the support brackets 61 via bolts 62, for example. The bolts 62 are inserted through the side walls 52 and 53 of the reverse gate 33 and screwed to the support brackets 61. The bolts 62 are respectively disposed along the up/down rotation axis Ag and at the right and left of the nozzle 47. The reverse gate 33 is thus enabled to rotate around the up/down rotation axis Ag with respect to the nozzle 47.

The front end portions of the respective side walls 52 and 53 include curved end surfaces 33*a* including portions that are arcuate-shaped around the up/down rotation axis Ag. The front end portions of the respective side walls 52 and 53 further include first rectilinear end surfaces 33*b* connected to upper ends of the curved end surfaces 33*a* and extending substantially upward and second rectilinear end surfaces 33*c* connected to lower ends of the curved end surfaces 33*a* and extending substantially downward.

Figure 6:
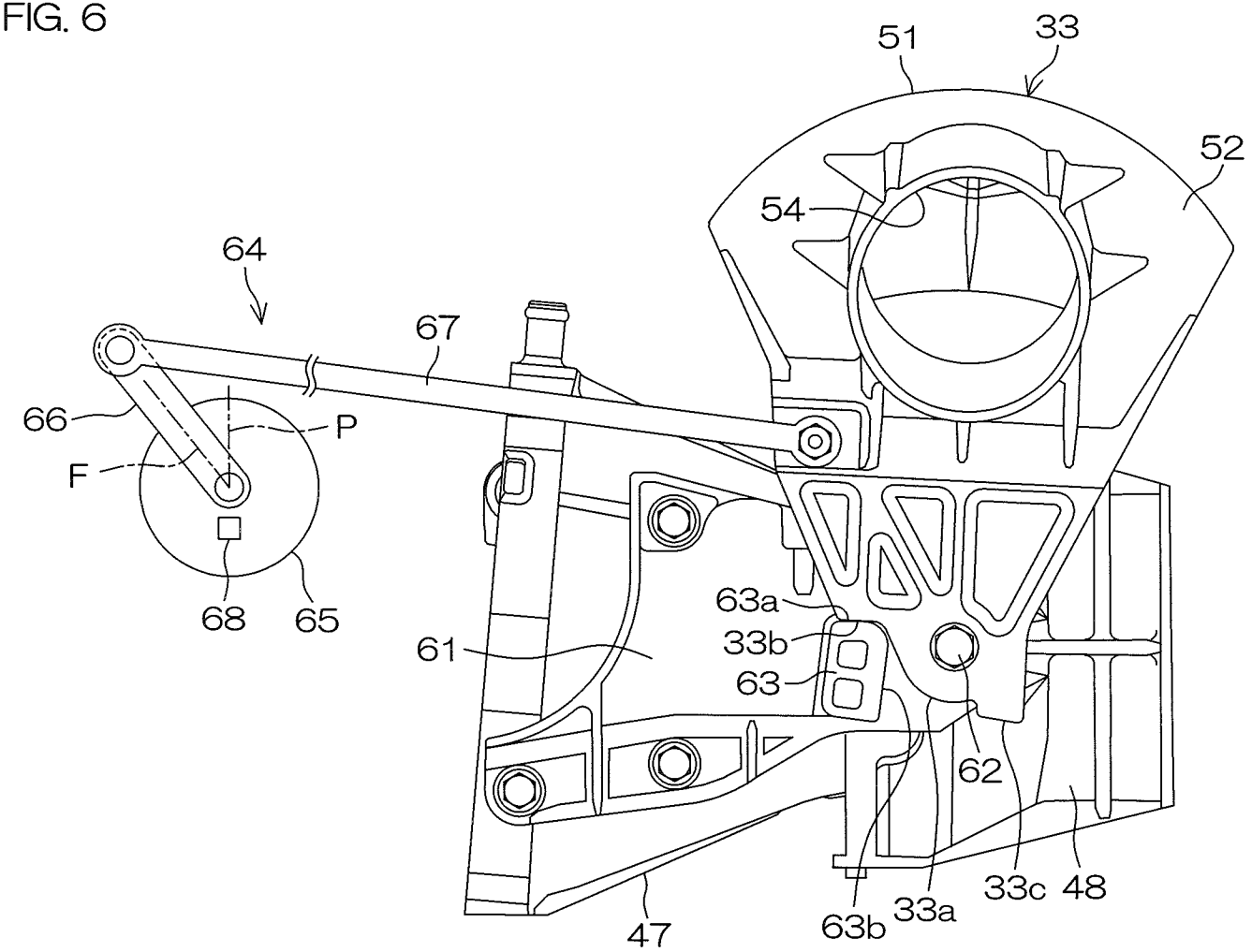
FIG. 6 is a schematic side view of the jet propelled watercraft in a state where the reverse gate is at a forward drive position.
Figure 7:
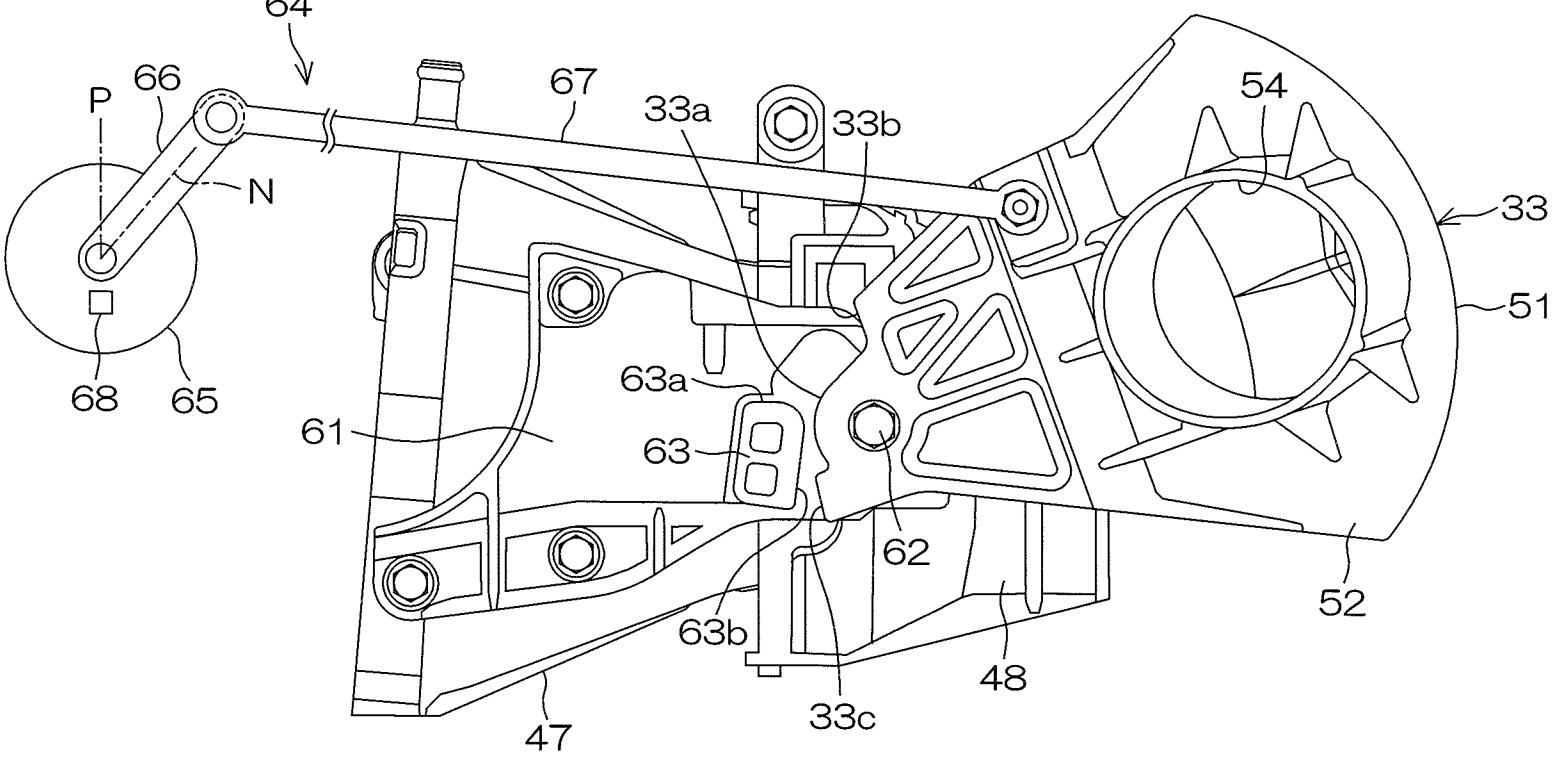
FIG. 7 is a schematic side view of the jet propelled watercraft in a state where the reverse gate is at a neutral position.

The reverse gate 33 is capable of moving to a reverse drive position shown in FIG. 4 and FIG. 5, a forward drive position shown in FIG. 6, and a neutral position shown in FIG. 7 by rotating around the up/down rotation axis Ag. The forward drive position is a position at which the jet port 31 is not covered at all by the rear wall 51 of the reverse gate 33 in a rear view viewed along the jetting direction of the water jetted from the jet port 31 of the deflector 48. The reverse drive position is a position at which the entire jet port 31 of the deflector 48 is covered by the rear wall 51 of the reverse gate 33 in the rear view. The neutral position is a predetermined position between the forward drive position and the reverse drive position and is a position at which a portion of the jet port 31 of the deflector 48 is covered by the rear wall 51 of the reverse gate 33 in the rear view.

In the state where the reverse gate 33 is disposed at the forward drive position (see FIG. 6), the jet port 31 of the deflector 48 is not covered by the reverse gate 33 and therefore the water jetted rearward from the outlet 42 of the nozzle 47 thus passes through the interior of the deflector 48 and is jetted rearward from the jet port 31. A thrust in a forward drive direction that drives the body 2 forward is thus generated.

In the state where the reverse gate 33 is disposed at the reverse drive position (see FIG. 4), the entire jet port 31 of the deflector 48 is covered by the reverse gate 33. The water jetted rearward from the jet port 31 thus collides against an inner surface of the reverse gate 33 and is thereafter jetted obliquely forward to the left and obliquely forward to the right from the left opening 54 and the right opening 55. The reverse gate 33 thus changes the direction of the water, jetted rearward from the jet port 31, toward the front. A thrust in a reverse drive direction that drives the body 2 in reverse is thus generated.

When the reverse gate 33 is disposed at the neutral position (see FIG. 7), a portion of the jet port 31 of the deflector 48 is covered by the reverse gate 33. Therefore, while a portion of the water jetted from the jet port 31 is jetted rearward, another portion of the water jetted from the jet port 31 is jetted obliquely forward to the left and obliquely forward to the right from the left opening 54 and the right opening 55. A thrust in the forward drive direction and a thrust in the reverse drive direction are thus generated. The neutral position is set, for example, at a position at which the forward drive direction thrust and the reverse drive direction thrust are equal or substantially equal.

Each support bracket 61 is provided with a stopper 63 which the reverse gate 33 is pressed against at the forward drive position (see FIG. 6) and the reverse drive position (see FIG. 4). The stopper 63 has a rectangular or substantially rectangular plate shape that is long in the up/down direction in side view. An upper end surface of the stopper 63 is a first stopper surface 63*a* and a rear end surface of the stopper is a second stopper surface 63*b*.

As shown in FIG. 6, when the reverse gate 33 is at the forward drive position, the first rectilinear end surfaces 33*b* of the respective side walls 52 and 53 of the reverse gate 33 are pressed against the first stopper surfaces 63*a* of the stoppers 63. As shown in FIG. 4 and FIG. 5, when the reverse gate 33 is at the reverse drive position, the second rectilinear end surfaces 33*c* of the respective side walls 52 and 53 of the reverse gate 33 are pressed against the second stopper surfaces 63*b* of the stoppers 63. As shown in FIG. 7, when the reverse gate 33 is at the neutral position, the reverse gate 33 is not pressed against the stoppers 63.

The jet propelled watercraft 1 includes a deflector moving mechanism (not shown) that rotates the deflector 48 to the right or left in accordance with an operation amount (steering angle) of the handle 8. The deflector moving mechanism mechanically couples the handle 8 and the deflector 48. The deflector moving mechanism includes, for example, a push-pull cable that transmits an actuation of the handle 8 to the deflector 48. The deflector moving mechanism may be an electrically driven moving mechanism that includes an electric motor, for example. A straight drive position of the handle 8 is associated with a straight drive position of the deflector 48. When the handle 8 is operated, the deflector 48 is rotated to the left or to the right by the deflector moving mechanism. The jetting direction of the water from the jet port 31 is thus changed to the right or left.

The jet propelled watercraft 1 further includes a reverse gate moving mechanism 64 (see FIG. 1, FIG. 4, FIG. 6, and FIG. 7) that rotates the reverse gate 33 up and down based on operation of the first accelerator operator 13 and the second accelerator operator 14. In the present preferred embodiment, the reverse gate moving mechanism 64 includes a shift actuator 65, a shift arm 66 rotated by the shift actuator 65, and a link 67 coupling the shift arm 66 and the reverse gate 33. In the present preferred embodiment, the shift actuator 65 preferably is an electric motor, for example.

The link 67 is pushed or pulled when the shift arm 66 is rotated by the shift actuator 65. The reverse gate 33 is thus rotated around the up/down rotation axis Ag. A shift position of the reverse gate 33 (hereinafter referred to simply as the "shift position") is detected by a shift position sensor 68. The shift position sensor 68 is an example of a reverse gate position detector, a shift position detector, or a shift state detector that detects the shift position or a shift state. In the present preferred embodiment, the shift position sensor 68 preferably is a potentiometer that detects a rotation angle (rotation amount) of the shift arm 66 from a reference position set in advance.

Figure 8:
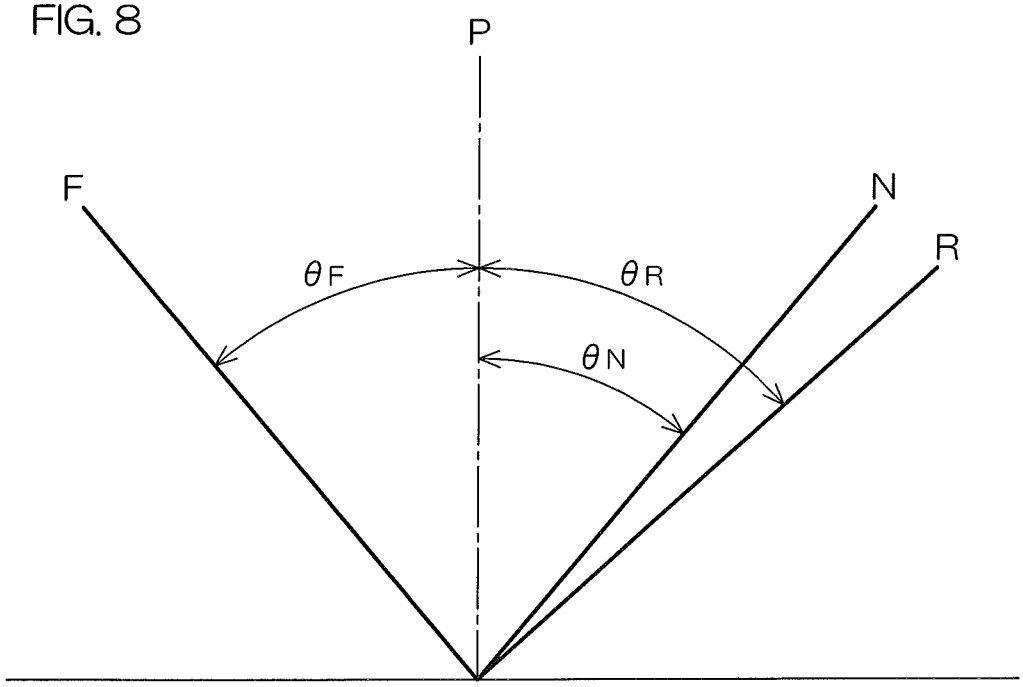
FIG. 8 is a schematic view of rotation angle positions of a shift arm at a forward drive position, a neutral position, and a reverse drive position.

FIG. 8 is a schematic view of rotation angle positions of the shift arm 66 at the forward drive position, the neutral position, and the reverse drive position. In the present preferred embodiment, the reference position P of the shift arm 66 is a position at which the shift arm 66 is perpendicular or substantially perpendicular to a horizontal plane of the body 2. A position F, at which the shift arm 66 is rotated in a counterclockwise direction by just a predetermined angle $\theta_F$ from the reference position P, indicates the rotation angle position of the shift arm 66 corresponding to the forward drive position of the reverse gate 33. A position R, at which the shift arm 66 is rotated in a clockwise direction by just a predetermined angle $\theta_R$ from the reference position P, indicates the rotation angle position of the shift arm 66 corresponding to the reverse drive position of the reverse gate 33. A position N, at which the shift arm 66 is rotated in the clockwise direction by just a predetermined angle $\theta_N$ from the reference position P, indicates the rotation angle position of the shift arm. 66 corresponding to the neutral position of the reverse gate 33.

Figure 9:
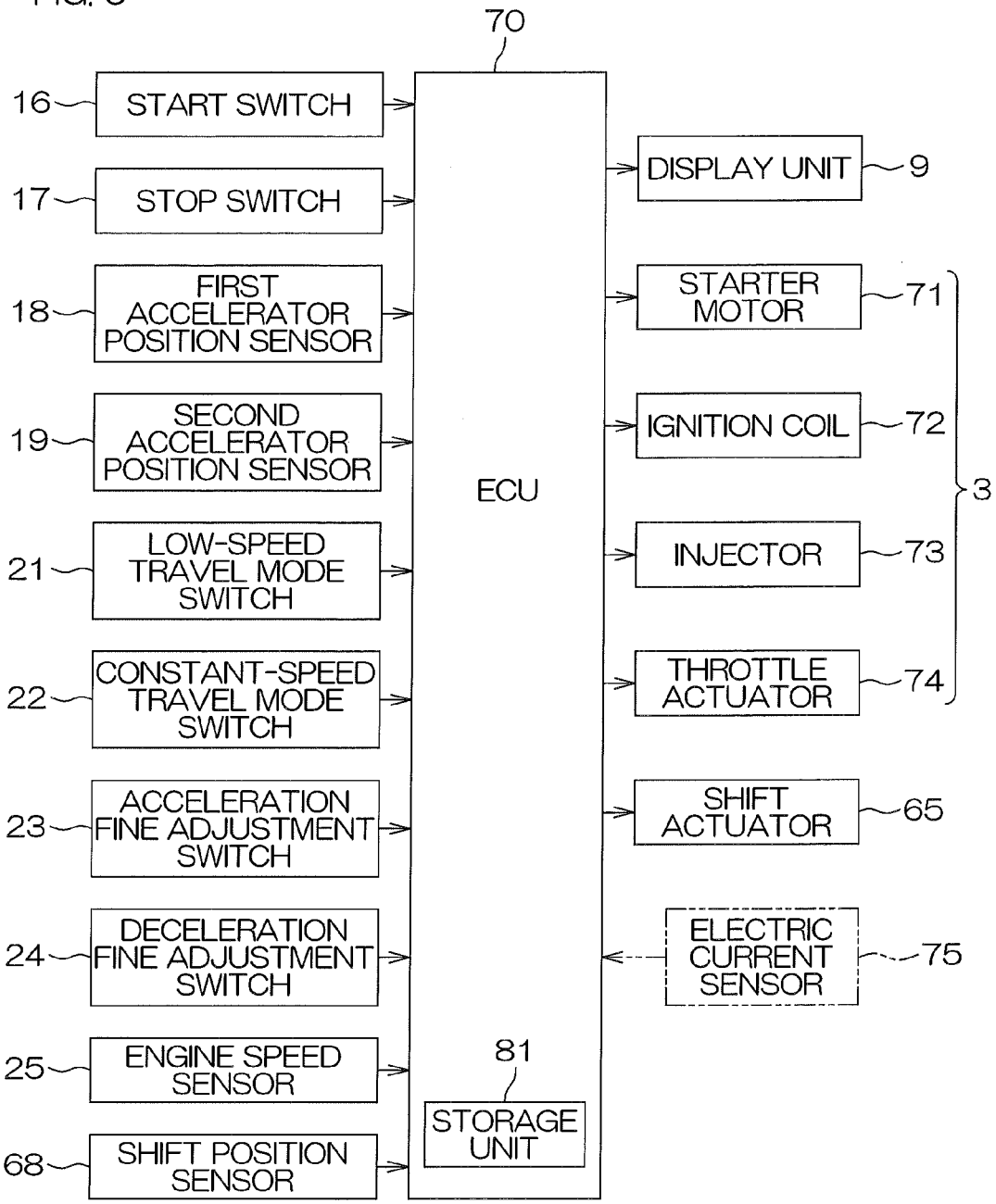
FIG. 9 is a block diagram for describing the electrical arrangement of the jet propelled watercraft.

FIG. 9 is a block diagram for describing the electrical configuration of the jet propelled watercraft 1. The engine 3, the shift actuator 65, the display 9, etc., are controlled by an ECU 70 (electronic controller) the defines a controller. The engine 3 includes a starter motor 71, an ignition coil 72, an injector 73, and a throttle actuator 74.

Switches, including the start switch 16, the stop switch 17, the low-speed travel mode switch 21, the constant-speed travel mode switch 22, the acceleration fine adjustment switch 23, and the deceleration fine adjustment switch 24, are connected to the ECU 70. Further, sensors, including the first accelerator position sensor 18, the second accelerator position sensor 19, the engine speed sensor 25, and the shift position sensor 68, are connected to the ECU 70.

Further, the display 9, and actuators, such as the starter motor 71, the ignition coil 72, the injector 73, the throttle actuator 74, the shift actuator 65, etc., are connected to the ECU 70. The starter motor 71 is configured to perform cranking of the engine 3. The injector 73 is configured to inject fuel into an air intake path of the engine 3. The throttle actuator 74 is configured to drive a throttle valve (not shown) of the engine 3 to adjust an amount of air supplied to the air intake path of the engine 3. The ignition coil 72 is configured to raise a voltage applied to a spark plug (not shown).

The ECU 70 includes a microcomputer (not shown) and a storage device such as a memory 81 storing a program thereof, etc. The ECU 70 further includes drive circuits (not shown) of the starter motor 71, the throttle actuator 74, and the shift actuator 65. Information expressing the angles $\theta_F$, $\theta_R$, and $\theta_N$ shown in FIG. 8 are stored in the storage device 81.

The ECU 70 calculates a first throttle opening degree Θ1 corresponding to the first accelerator operation amount Am1 detected by the first accelerator position sensor 18. The ECU 70 further calculates a second throttle opening degree Θ2 corresponding to the second accelerator operation amount Am2 detected by the second accelerator position sensor 19.

Figure 10A:
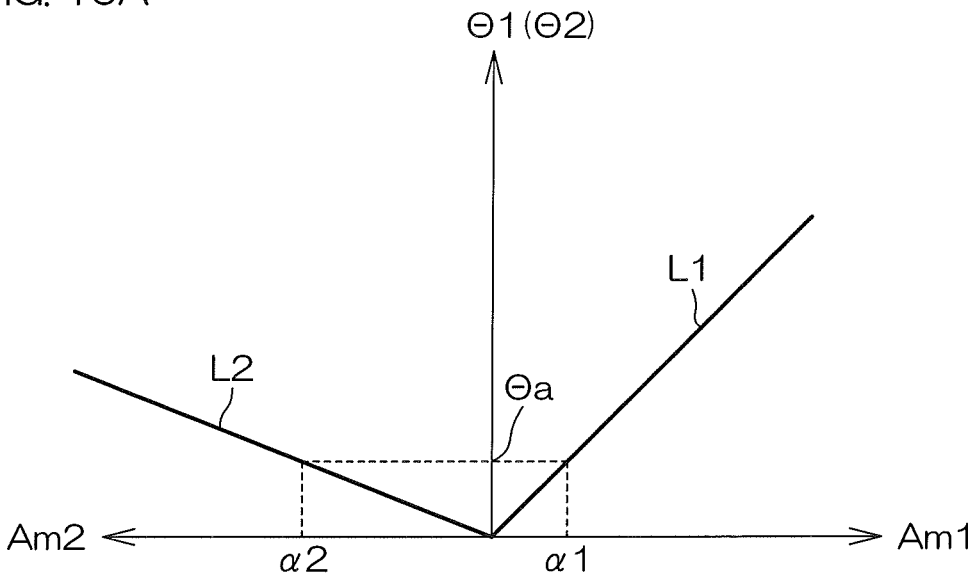
FIG. 10A is a characteristics diagram of a setting example of a throttle opening degree with respect to an accelerator operation amount.

A straight line L1 in FIG. 10A indicates a setting example of the first throttle opening degree Θ1 with respect to the first accelerator operation amount Am1. A straight line L2 in FIG. 10A indicates a setting example of the second throttle opening degree Θ2 with respect to the second accelerator operation amount Am2. The first throttle opening degree Θ1 is set so as to increase linearly as the first accelerator operation amount Am1 increases. Similarly, the second throttle opening degree Θ2 is set so as to increase linearly as the second accelerator operation amount Am2 increases. However, with the present preferred embodiment, a rate of change of the second throttle opening degree Θ2 with respect to the second accelerator operation amount Am2 (slope of the straight line L2) is smaller than a rate of change of the first throttle opening degree Θ1 with respect to the first accelerator operation amount Am1 (slope of the straight line L1). Therefore, when the first accelerator operation amount Am1 and the second accelerator operation amount Am2 are of the same value, the second throttle opening degree Θ2 is less than the first throttle opening degree Θ1.

In the ordinary travel mode, the ECU 70 performs an ordinary rotational speed control process and an ordinary shift control process. In the ordinary rotational speed control process, the ECU 70 controls the throttle actuator 74 in accordance with the first throttle opening degree Θ1 and the second throttle opening degree Θ2 to control the engine speed. Specifically, when the shift position is the forward drive position, the ECU 70 controls the throttle opening degree, for example, in accordance with a difference between the first throttle opening degree Θ1 and the second throttle opening degree Θ2 (hereinafter referred to as the "throttle opening degree difference (Θ1−Θ2)"). When the shift position is the reverse drive position or the neutral position, the ECU 70 controls the throttle opening degree, for example in accordance with the throttle opening degree Θ2.

The ECU 70 may perform the ordinary rotational speed control process by the same method as a rotational speed control method disclosed in United States Patent Application Publication No. 2013/0344754. The entire contents of US Patent Application Publication No. 2013/0344754 are incorporated herein by reference.

In the ordinary shift control process, the ECU 70 controls the shift actuator 65 in accordance with the first throttle opening degree Θ1, the second throttle opening degree Θ2, and the engine speed V detected by the engine speed sensor 25 to control the shift position.

When for example, in a case where the shift position is the forward drive position, the throttle opening degree difference (Θ1−Θ2) is less than a predetermined value, the second accelerator operator 14 is operated, and the engine speed V is greater than a predetermined speed, the ECU 70 switches the shift position to the neutral position. Specifically, the ECU 70 sets a target shift position to the neutral position and thereafter controls the shift actuator 65 to move the reverse gate 33 to the target shift position. The most recent target shift position is held in the storage 81. The ECU 70 judges whether or not the reverse gate 33 has reached the target shift position. Specifically, the ECU 70 judges whether or not the rotation angle detected by the shift position sensor 68 has become equal to the angle, among the angles $\theta_F$, $\theta_R$, and $\theta_N$ stored in the storage 81, corresponding to the target shift position.

When for example, in a case where the shift position is the forward drive position, the throttle opening degree difference (Θ1−Θ2) is less than the predetermined value, the second accelerator operator 14 is operated, and the engine speed V is not more than the predetermined speed, the ECU 70 switches the shift position to the reverse drive position. Specifically, the ECU 70 sets the target shift position to the reverse drive position and thereafter controls the shift actuator 65 to move the reverse gate 33 to the target shift position.

When for example, in a case where the shift position is the neutral position, the engine speed V is less than the predetermined speed and the second accelerator operator 14 is operated, the ECU 70 switches the shift position to the reverse drive position. Specifically, the ECU 70 sets the target shift position to the reverse drive position and thereafter controls the shift actuator 65 to move the reverse gate 33 to the target shift position.

When for example, in a case where the shift position is the neutral position, the engine speed V is less than the predetermined speed, the second accelerator operator 14 is not operated, and the first accelerator operator 13 is operated, the ECU 70 switches the shift position to the forward drive position. Specifically, the ECU 70 sets the target shift position to the forward drive position and thereafter controls the shift actuator 65 to move the reverse gate 33 to the target shift position.

When for example, in a case where the shift position is the reverse drive position, the second accelerator operator 14 is not operated and the first accelerator operator 13 is operated, the ECU 70 switches the shift position to the forward drive position. Specifically, the ECU 70 sets the target shift position to the forward drive position and thereafter controls the shift actuator 65 to move the reverse gate 33 to the target shift position.

When for example, in a case where the shift position is the reverse drive position, a state where the second accelerator operator 14 and the first accelerator operator 13 are not operated is sustained for not less than a predetermined time, the ECU 70 switches the shift position to the neutral position. Specifically, the ECU 70 sets the target shift position to the neutral position and thereafter controls the shift actuator 65 to move the reverse gate 33 to the target shift position.

The reverse gate 33 is thus controlled in position in accordance with the operation of the second accelerator operator 14. That is, the second accelerator operator 14 and the second accelerator position sensor 19 that detects the operation amount thereof constitute a shift switching signal output that outputs a shift switching signal or a shift position command signal output that outputs a shift position command signal.

The ECU 70 may perform the ordinary shift control process by the same method as a shift control method disclosed in United States Patent Application Publication No. 2013/0344754.

Figure 11:
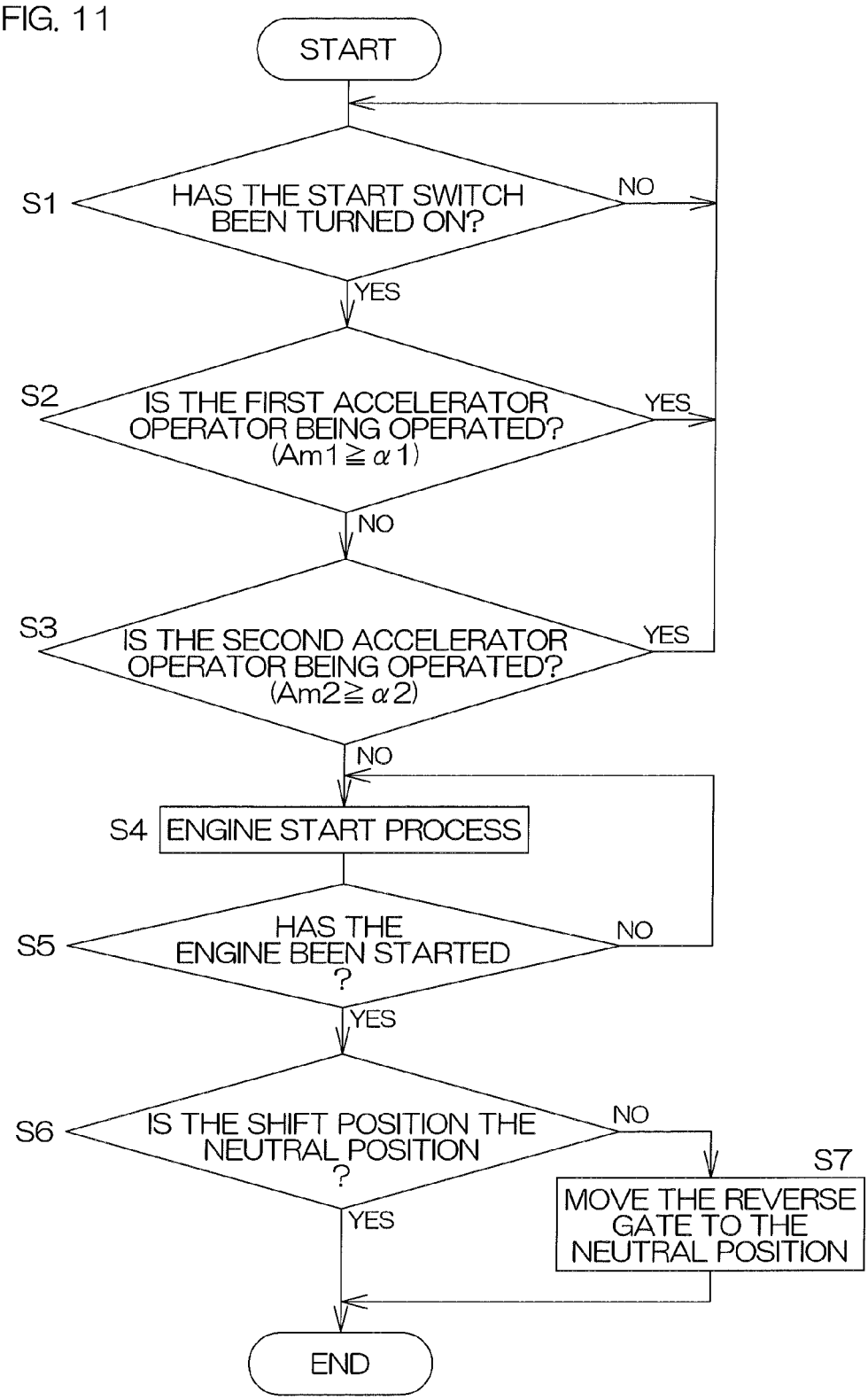
FIG. 11 is a flowchart of a procedure of an example of an engine start control process executed by an ECU.

FIG. 11 is a flowchart of a procedure of an example of an engine start control process executed by the ECU 70.

The ECU 70 determines whether or not the start switch 16 has been turned on in a state where the engine is stopped (step S1). If the start switch 16 has not been turned on (step S1: NO), the ECU 70 returns to step S1.

If in step S1, it is determined that the start switch 16 has been turned on (step S1: YES), the ECU 70 determines whether or not the first accelerator operator 13 is being operated (step S2). Specifically, the ECU 70 determines whether or not the first accelerator operation amount Am1 detected by the first accelerator position sensor 18 is not less than a first threshold α1. The ECU 70 determines that the first accelerator operator 13 is being operated if the first accelerator operation amount Am1 is not less than the first threshold α1, and determines that the first accelerator operator 13 is not being operated if the first accelerator operation amount Am1 is less than the first threshold α1.

If it is determined that the first accelerator operator 13 is not being operated (step S2: NO), the ECU 70 determines whether or not the second accelerator operator 14 is being operated (step S3). Specifically, the ECU 70 determines whether or not the second accelerator operation amount Am2 detected by the second accelerator position sensor 19 is not less than a second threshold α2. The ECU 70 determines that the second accelerator operator 14 is being operated if the second accelerator operation amount Am2 is not less than the second threshold α2, and determines that the second accelerator operator 14 is not being operated if the second accelerator operation amount Am2 is less than the second threshold α2.

With the present preferred embodiment, the second threshold α2 is set to a value greater than the first threshold α1 as shown in FIG. 10A. Also with the present preferred embodiment, the first threshold α1 and the second threshold α2 are set so that a first throttle opening degree Θ1 corresponding to the first threshold α1 and a second throttle opening degree Θ2 corresponding to the second threshold α2 are of equal value (Θa). That is, the engine speed corresponding to the first threshold α1 and the engine speed corresponding to the second threshold α2 are equal or substantially equal to each other.

If it is determined that the second accelerator operator 14 is not being operated (step S3: NO), the ECU 70 performs an engine starting process (step S4). Specifically, the ECU 70 drives the starter motor 71, the ignition coil 72, and the injector 73 and performs fuel supply control and ignition control to start the engine 3. The ECU 70 then determines whether or not the engine 3 has been started (step S5). Specifically, the ECU 70 determines the starting of the engine 3 based on whether or not the engine speed V detected by the engine speed sensor 25 is not less than a predetermined start determination threshold β1. That is, the ECU 70 determines that the engine 3 has been started if the engine speed V is not less than the start determination threshold β1 and determines that the engine 3 has not been started if the engine speed V is less than the start determination threshold β1. If it is determined that the engine 3 has not been started (step S5: NO), the ECU 70 returns to step S4 to perform the engine starting process.

If in step S5, it is determined that the engine 3 has been started (step S5: YES), the ECU 70 determines whether or not the shift position is the neutral position (step S6). If the shift position is other than the neutral position (step S6: NO), the ECU 70 sets the target shift position to the neutral position and thereafter controls the shift actuator 65 to move the reverse gate 33 to the neutral position (step S7). The ECU 70 then ends the engine start control process and starts control in the ordinary travel mode.

If in step S6, it is determined that the shift position is the neutral position (step S6: YES), the ECU 70 ends the engine start control process and starts control in the ordinary travel mode.

If in step S2, it is determined that the first accelerator operator 13 is being operated (step S2: YES), the ECU 70 returns to step S1. The ECU 70 also returns to step S1 if in step S3, it is determined that the second accelerator operator 14 is being operated (step S3: YES).

If it is determined that the first accelerator operator 13 is being operated in step S2 or it is determined that the second accelerator operator 14 is being operated in step S3, the ECU 70 may return to step S1 upon displaying an error on the display 9.

With the start control process of FIG. 11, even when the start switch 16 is turned on, the starting of the engine 3 is prohibited if it is determined that the first accelerator operator 13 is being operated (step S2). Driving of the body 2 forward by the moving of the reverse gate 33 to the forward drive position immediately after the starting of the engine is thus prevented. Further, the rotational speed of the engine 3 immediately after the starting of the engine is suppressed to a low speed and application of a large propulsive force to the body 2 immediately after the starting of the engine is avoided.

With the start control process of FIG. 11, it is determined that the first accelerator operator 13 is being operated when the first accelerator operation amount Am1 is not less than the first threshold α1. Whether or not the first accelerator operator 13 is being operated is thus determined appropriately, and accordingly, engine start prohibition when the first accelerator operator 13 is being operated is performed appropriately.

With the present preferred embodiment, the first accelerator operator 13 includes the accelerator lever. The first accelerator operation amount Am1 corresponds to the operation angle of the accelerator lever. The operation state of the accelerator lever is thus determined appropriately and start prohibition of the engine 3 during accelerator lever operation is performed appropriately. More specifically, the starting of the engine 3 is prohibited when the operation angle of the accelerator lever is not less than the predetermined threshold. The starting of the engine 3 is thus prohibited appropriately.

With the start control process of FIG. 11, even when the start switch 16 is turned on, the starting of the engine 3 is prohibited if it is determined that the second accelerator operator 14 is being operated (step S3). The driving of the body 2 in reverse by the moving of the reverse gate 33 to the reverse drive position immediately after engine start is thus prevented. Further, the rotational speed of the engine 3 is suppressed to be low immediately after engine start and application of a large propulsive force to the body 2 immediately after engine start is avoided.

With the start control process of FIG. 11, it is determined that the second accelerator operator 14 is being operated when the second accelerator operation amount Am2 is not less than the second threshold α2. Whether or not the second accelerator operator 14 is being operated is thus determined appropriately, and accordingly, engine start prohibition when the second accelerator operator 14 is being operated is performed appropriately.

With the present preferred embodiment, the second accelerator operator 14 includes the reverse lever. The second accelerator operation amount Am2 corresponds to the operation angle of the reverse lever. The operation state of the reverse lever is thus determined appropriately and start prohibition of the engine 3 during reverse lever operation is performed appropriately. More specifically, the starting of the engine 3 is prohibited when the operation angle of the reverse lever is not less than the predetermined threshold. The starting of the engine 3 is thus prohibited appropriately.

With the present preferred embodiment, the first throttle opening degree Θ1 corresponding to the first threshold α1 and the second throttle opening degree Θ2 corresponding to the second threshold α2 are equal or substantially equal. That is, the rotational speed of the engine 3 corresponding to the first threshold α1 and the rotational speed of the engine 3 corresponding to the second threshold α2 are equal. Operations of the first accelerator operator 13 and the second accelerator operator 14 are thus determined based on the rotational speed of the engine 3. The operations of the first accelerator operator 13 and the second accelerator operator 14 is thus determined from a standpoint of the magnitude of the propulsive force generated when the engine 3 is started. The start prohibition of the engine 3 is thus controlled more appropriately.

With the start control process of FIG. 11, if, immediately after engine start, the shift position is determined to be other than the neutral position, the reverse gate 33 is moved to the neutral position (steps S6 and S7). As shall be described below, with the present preferred embodiment, the reverse gate 33 is moved to the forward drive position or the reverse drive position when the engine 3 is stopped. It is thus determined that the first accelerator operator 13 and the second accelerator operator 14 are not being operated, and when the engine 3 is started, the reverse gate 33 is at the forward drive position or the reverse drive position. Therefore, by performing the start control process of FIG. 11, the reverse gate 33 is moved to the neutral position immediately after engine start and the body 2 is thus prevented from being driven forward or in reverse immediately after engine start.

Even if, due to some cause, the engine 3 is started in a state where at least one of either the first accelerator operator 13 or the second accelerator operator 14 is being operated, the body 2 is suppressed from being driven forward or in reverse immediately after engine start. For example, if the first or second accelerator position sensor 18 or 19 is malfunctioning, the determination of step S2 or S3 will not be performed correctly and the engine 3 may thus be started in a state where at least one of either the first or second accelerator operator 13 or 14 is being operated. Even in such a case, the reverse gate 33 is moved to the neutral position immediately after engine start and therefore the driving of the body 2 forward or in reverse immediately after engine start is avoided.

Figure 12:
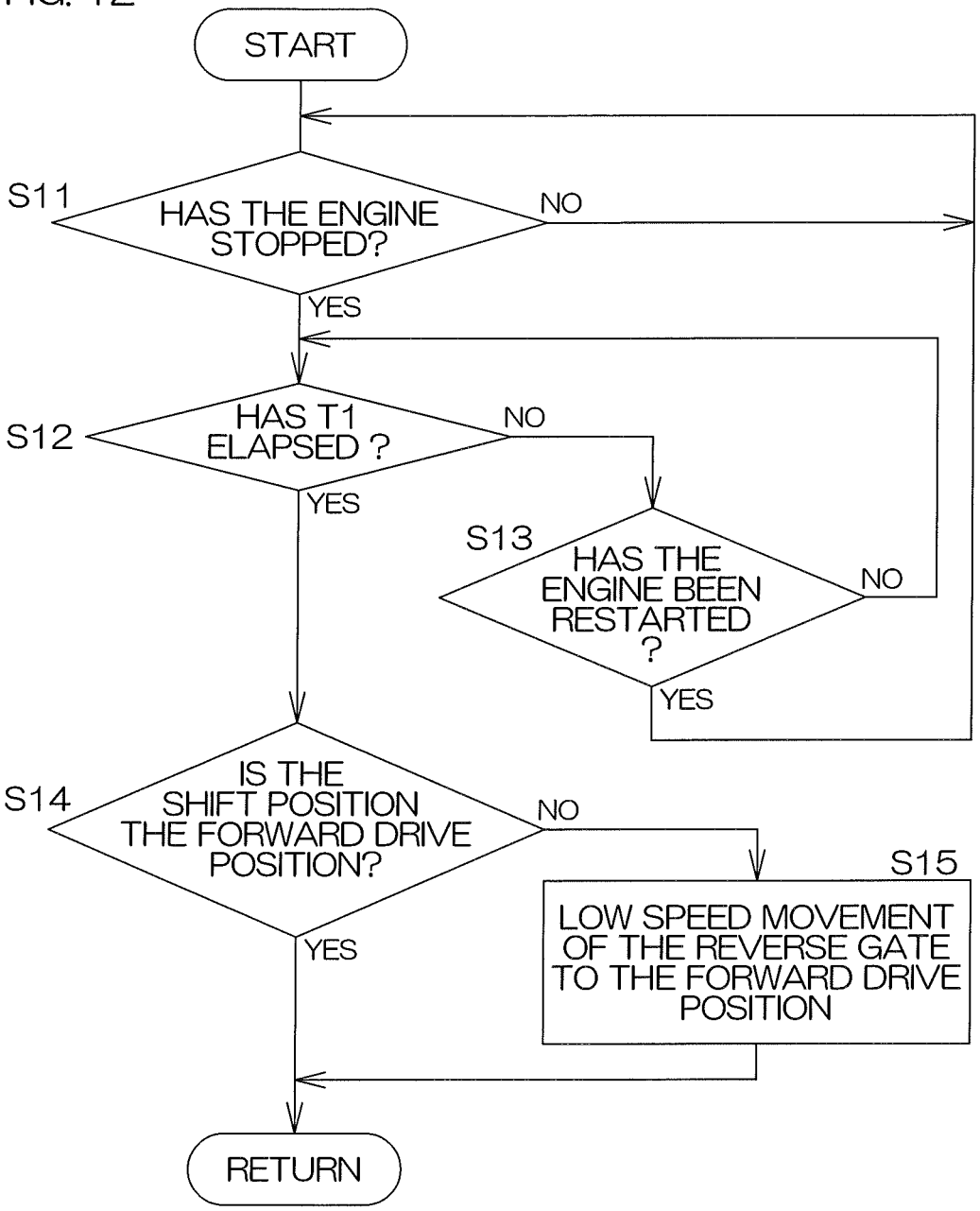
FIG. 12 is a flowchart of a procedure of an example of a shift control process executed by the ECU when the engine is stopped.

FIG. 12 is a flowchart of a procedure of an example of a shift control process executed by the ECU 70 when the engine is stopped.

The ECU 70 determines whether or not the engine 3 has stopped (step S11). Specifically, the ECU 70 acquires the engine speed V detected by the engine speed sensor 25 and stores the acquired engine speed V in the storage or memory 81. For example, the engine speed V that was acquired previously and the engine speed V acquired currently are stored in the storage or memory 81. The ECU 70 determines that the engine 3 has stopped if a condition that the previously acquired engine speed V is not less than a predetermined stoppage determination threshold β2 and the currently acquired engine speed V is less than the stoppage determination threshold β2 is satisfied. If this condition is not met, the ECU 70 determines that the engine 3 is being driven or that the state in which the engine is stopped is sustained.

If in step S11, it is determined that the engine 3 is being driven or that the state in which the engine is stopped is sustained (step S11: NO), the ECU 70 returns to step S11. If in step S11, it is determined that the engine 3 has stopped (step S11: YES), the ECU 70 determines whether or not a predetermined time T1 has elapsed since the engine 3 stopped (step S12). The predetermined time T1 may be set, for example, to about 0.5 seconds. If it is determined that the predetermined time T1 has not elapsed since the engine 3 stopped (step S12: NO), the ECU 70 determines whether or not the engine 3 has been restarted (step S13). Specifically, the ECU 70 determines whether or not the engine speed V detected by the engine speed sensor 25 has become not less than a predetermined restart determination threshold β3. The restart determination threshold β3 is set to a value not less than the stoppage determination threshold β2. The ECU 70 judges that the engine 3 has been restarted if the engine speed V is not less than the restart determination threshold β3 and judges that the engine 3 is in the stopped state if the engine speed V is less than the restart determination threshold β3.

If in step S13, it is determined that the engine 3 has been restarted (step S13: YES), the ECU 70 returns to step S11. If in step S13, it is determined that the engine 3 has not been restarted (step S13: NO), the ECU 70 returns to step S12. Therefore, when the predetermined time T1 elapses without the engine 3 being restarted after it has been determined in step S11 that the engine 3 has stopped, a positive judgment is made in step S12. If the positive judgment is made in step S12, the ECU 70 enters step S14.

In step S14, the ECU 70 determines whether or not the shift position is the forward drive position (step S14). If it is determined that the shift position is other than the forward drive position (the neutral position or the reverse drive position) (step S14: NO), the ECU 70 sets the target shift position to the forward drive position and thereafter controls the shift actuator 65 to move the reverse gate 33 to the forward drive position (step S15). In this process, the ECU 70 decreases an electric current supplied to the shift actuator 65 with respect to that supplied during ordinary shift control to make the movement speed of the reverse gate 33 slower than the movement speed of the reverse gate 33 during the ordinary shift control. The reason for this is that the movement of the reverse gate 33 to the forward drive position when the engine is stopped is not performed intentionally by the operator. Thereafter, the process performed by the ECU 70 returns to step S11.

If it is determined in step S14 that the shift position is the forward drive position (step S14: YES), the ECU 70 returns to step S11.

In the process of FIG. 12, when, after engine stoppage, the predetermined time T1 elapses without restart of the engine 3 (YES in step S12), it is determined whether or not the shift position is the forward drive position (step S14). If the shift position is determined to be other than the forward drive position, the reverse gate 33 is moved to the forward drive position (step S15). The reverse gate 33 is thus kept at the forward drive position after engine stoppage. As mentioned above, when the reverse gate 33 is at the forward drive position, the first rectilinear end surfaces 33*b* of the respective side walls 52 and 53 of the reverse gate 33 are in a state of being pressed against the first stopper surfaces 63*a* of the stoppers 63 (see FIG. 6). The reverse gate 33 is thus stabilized after engine stoppage.

In many cases, the jet propelled watercraft 1 is stored on land. Frequently before storing the jet propelled watercraft 1 on land, the jet pump 32 is washed with water on land. In water-washing the jet pump 32, the reverse gate 33 will be an obstacle if the reverse gate 33 is at the neutral position. With the watercraft according to U.S. Pat. No. 6,547,611, with which the reverse gate is moved to the neutral position when the engine is stopped, the engine must be started to move the reverse gate to the forward drive position in order to perform water-washing of the jet pump. On the other hand, with the present preferred embodiment, the reverse gate 33 is kept at the forward drive position after engine stoppage. Therefore there is no need to start the engine 3 to move the reverse gate 33 in order to water-wash the jet pump 32. The jet propelled watercraft 1 that is easy in maintenance after use is thus provided.

With the process of FIG. 12, when the engine 3 is stopped, step S14 is not entered immediately but step S14 is entered after the predetermined time T1 elapses without the engine 3 being restarted (see steps S12 and S13). The reason for this shall now be described.

As described with the engine start control process of FIG. 11, if when the engine 3 is started, the shift position is other than the neutral position, the reverse gate 33 is moved to the neutral position. Therefore, if the process of the ECU 70 enters step S14 immediately when the engine 3 is stopped, the switching of the shift position may be performed repeatedly when the engine is restarted immediately after engine stoppage. For example, when the engine 3 is stopped with the reverse gate 33 being at a position other than the forward drive position, the shift position is switched from the neutral position or the reverse drive position to the forward drive position by the processes of steps S14 and S15. If the engine is restarted immediately thereafter, the shift position is switched from the forward drive position to the neutral position. To avoid such wasteful switching of the shift position, in the present preferred embodiment, the process of the ECU 70 is made to enter step S14 under the condition that the predetermined time T1 elapses without the engine 3 being restarted after the engine 3 has stopped.

Figure 13:
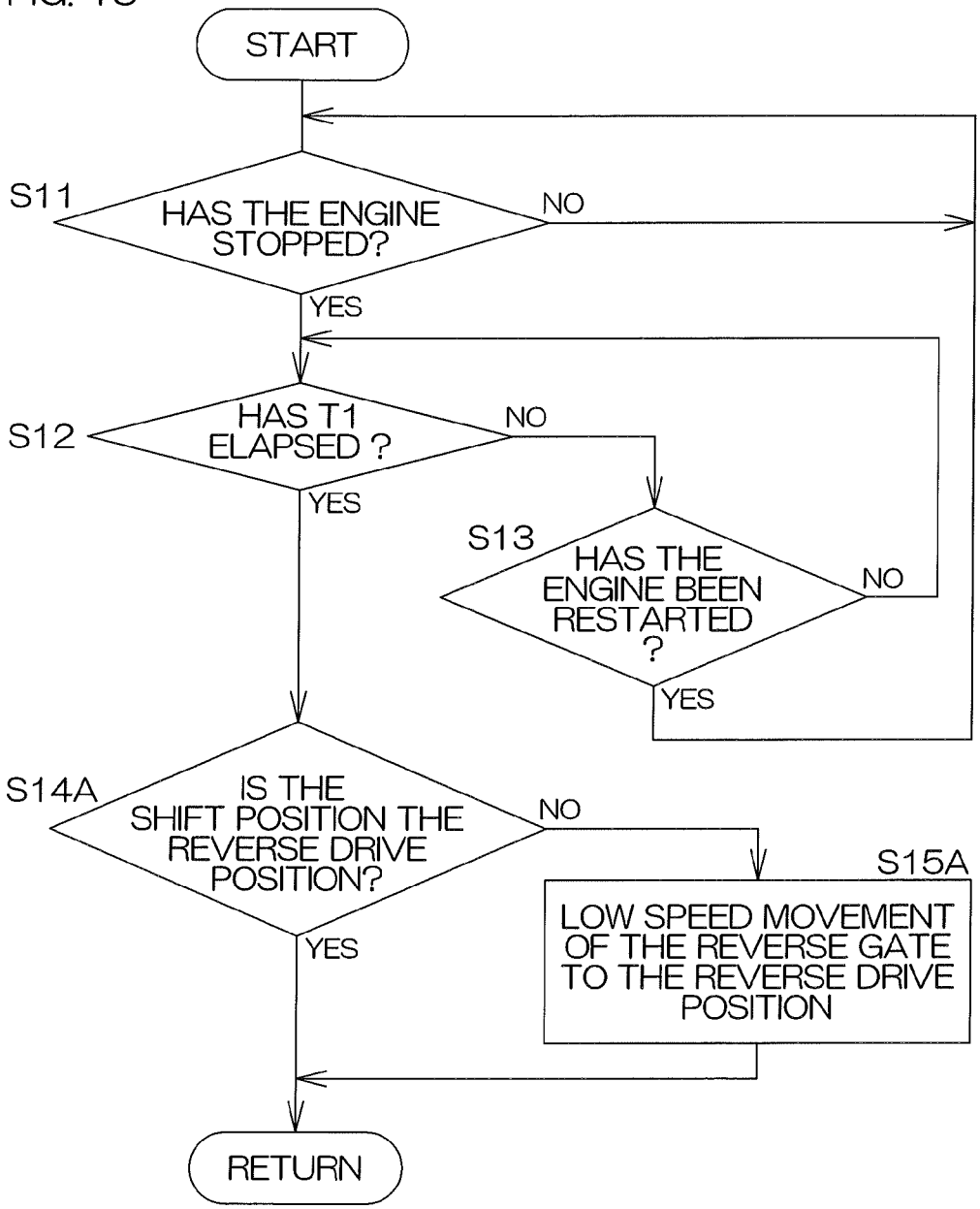
FIG. 13 is a flowchart of a procedure of another example of a shift control process executed by the ECU when the engine is stopped.

FIG. 13 is a flowchart of a procedure of another example of a shift control process executed by the ECU 70 when the engine is stopped. The processes of steps S11, S12, and S13 of FIG. 13 are respectively the same as the processes of steps S11, S12, and S13 of FIG. 12 and description thereof shall thus be omitted.

If in step S12, it is determined that the predetermined time T1 has elapsed without the engine 3 being restarted after the engine 3 has stopped (step S12: YES), the ECU 70 determines whether or not the shift position is the reverse drive position (step S14A). If it is determined that the shift position is other than the reverse drive position (the neutral position or the forward drive position) (step S14A: NO), the ECU 70 controls the shift actuator 65 to move the reverse gate 33 to the reverse drive position (step S15A). In this process, the ECU 70 decreases the electric current supplied to the shift actuator 65 with respect to that supplied during ordinary shift control to make the movement speed of the reverse gate 33 slower than the movement speed of the reverse gate 33 during the ordinary shift control. Thereafter, the ECU 70 returns to step S11.

If it is determined in step S14A that the shift position is the reverse drive position (step S14A: YES), the ECU 70 returns to step S11.

By the process of FIG. 13, the reverse gate 33 is kept at the reverse drive position after engine stoppage. As mentioned above, when the reverse gate 33 is at the reverse drive position, the second rectilinear end surfaces 33*c* of the respective side walls 52 and 53 of the reverse gate 33 are in a state of being pressed against the second stopper surfaces 63*b* of the stoppers 63 (see FIG. 4). The reverse gate 33 is thus stabilized after engine stoppage.

Figure 14:
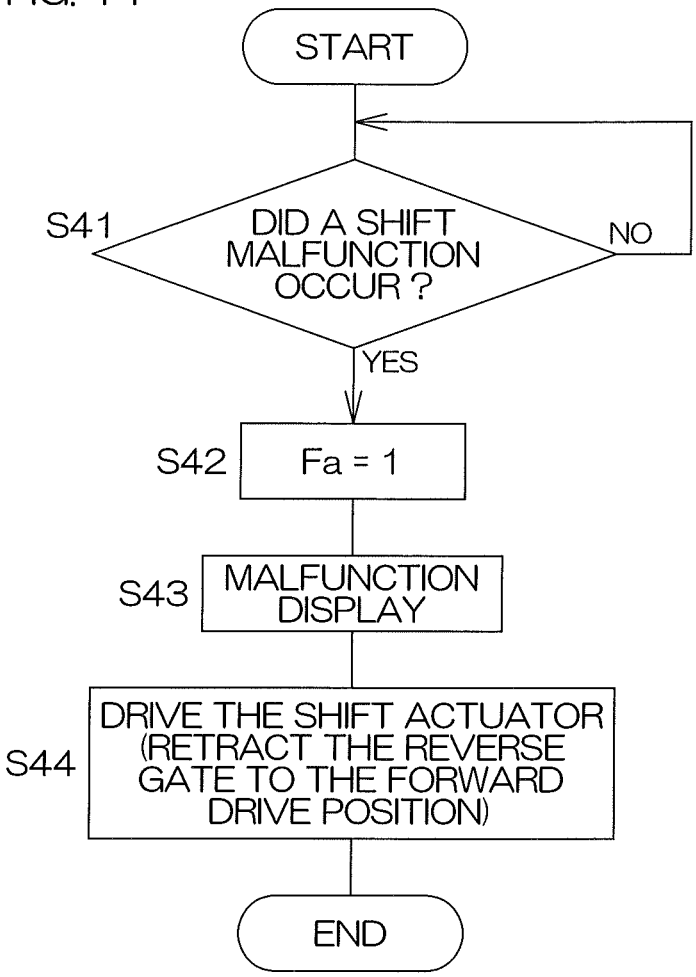
FIG. 14 is a flowchart of a procedure of an example of a shift malfunction monitoring process performed by the ECU.

FIG. 14 is a flowchart of a procedure of an example of a shift malfunction monitoring process performed by the ECU 70.

The ECU 70 determines whether or not a shift malfunction is occurring (step S41). The ECU 70 determines that the shift malfunction has occurred when a malfunction is occurring in at least one of either the reverse gate moving mechanism 64 or the shift position sensor 68. Whether or not the shift malfunction is occurring is determined, for example, as follows. That is, a rotation angle sensor that detects a rotation angle position of the electric motor that is the shift actuator 65 is provided. The shift malfunction is determined to be occurring if the rotation angle position detected by the rotation angle sensor and the reverse gate position detected by the shift position sensor 68 are not in a predetermined correlation relationship. In place of or in addition to such a malfunction determination, the following malfunction determination may be performed. The shift malfunction is determined to be occurring when a state in which the reverse gate position detected by the shift position sensor 68 differs from the control position of the ECU 70 is sustained for not less than a predetermined time.

If it is determined that the shift malfunction is not occurring (step S41: NO), the ECU 70 returns to step S41. On the other hand, if it is determined that the shift malfunction is occurring (step S41: YES), the ECU 70 sets a malfunction flag Fa (Fa=1) (step S42). The malfunction flag Fa is reset (Fa=0) in an initial state. Also, the ECU 70 displays on the display 9 that a shift malfunction has occurred (step S43).

Thereafter, the ECU 70 provides, to the shift actuator 65, a drive signal to drive the shift actuator 65 for a predetermined time in a direction of moving the reverse gate 33 toward the forward drive position (step S44). The predetermined time is set to a time sufficient to make the reverse gate 33 move to the forward drive position when the reverse gate 33 is at the reverse drive position. The reverse gate 33 is thus moved to the forward drive position if the shift actuator 65 is not malfunctioning. The jet propelled watercraft 1 is thus driven forward and made to return to port reliably.

Although in step S44 described above, the reverse gate 33 is preferably moved to the forward drive position, the reverse gate 33 may instead be moved to a position (for example, a position between the forward drive position and the neutral position) other than the forward drive position. In this case, the engine speed is preferably set to a value greater than an idling rotational speed.

Figure 15A:
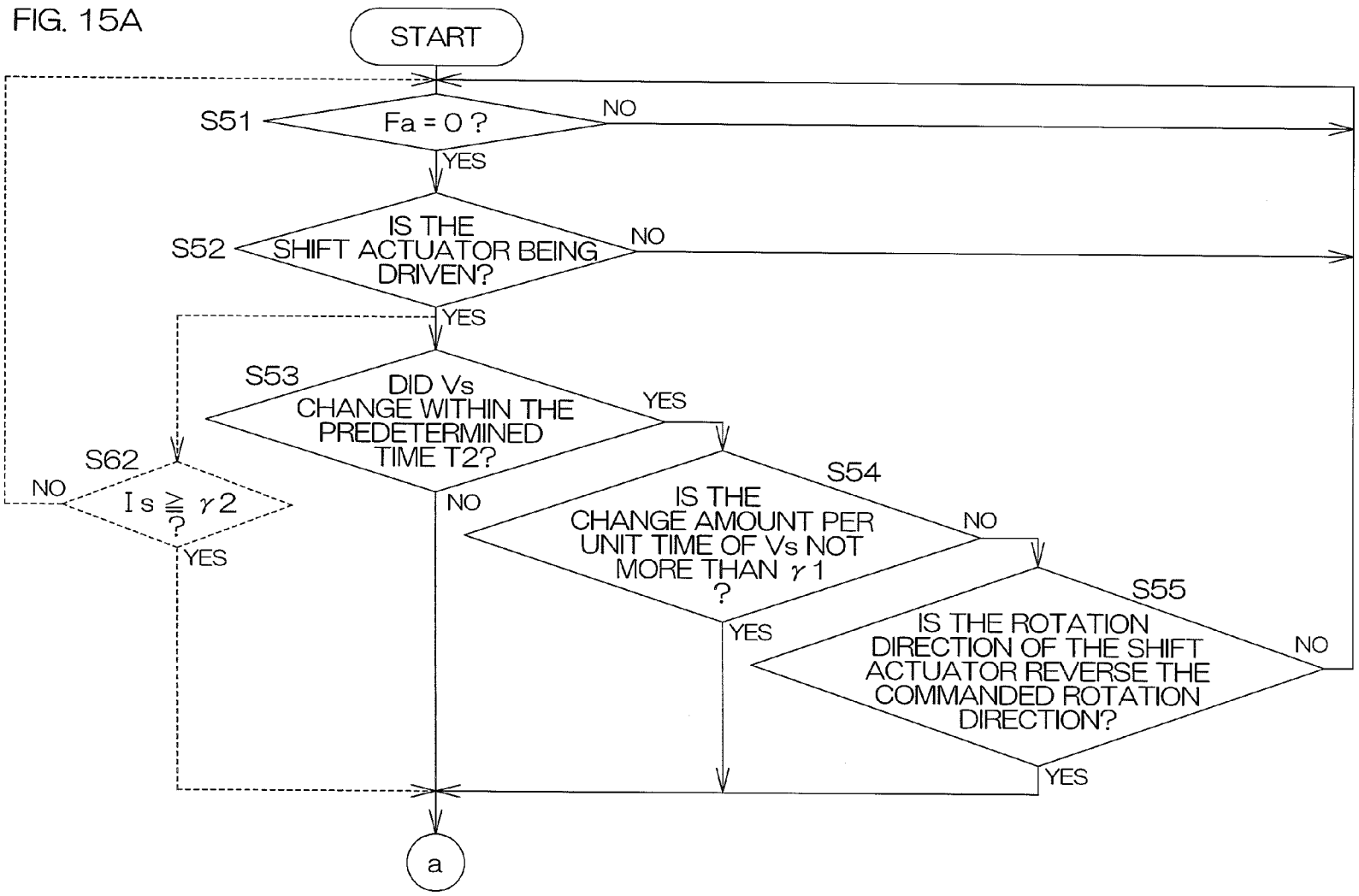
FIG. 15A is a flowchart of a portion of a procedure of an example of a movement error monitoring process performed by the ECU.
Figure 15B:
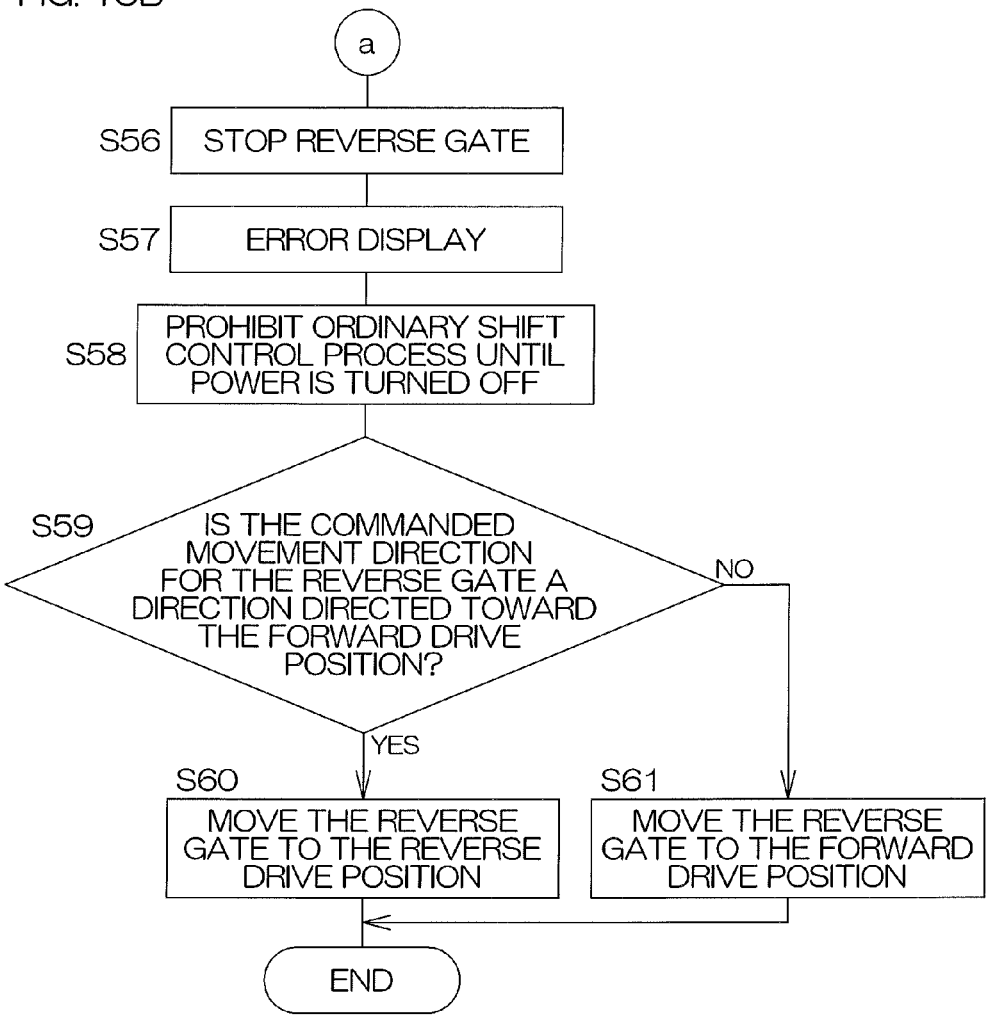
FIG. 15B is a flowchart of a portion of the procedure of the example of the movement error monitoring process performed by the ECU.

FIG. 15A and FIG. 15B are flowcharts of a procedure of an example of a movement error monitoring process performed by the ECU 70. A "movement error" refers to a state where the movement of the reverse gate 33 is obstructed by an obstacle, etc., when the shift actuator 65 is being driven to move the reverse gate 33. The movement error monitoring process is a process of monitoring whether or not a movement error has occurred and performing a movement error process when the movement error has occurred. In addition to being executed when the engine 3 is being driven, the movement error monitoring process is also executed when the engine 3 is being stopped.

The ECU 70 determines whether or not the malfunction flag Fa is reset (Fa=0) (step S51). If the malfunction flag Fa is set (Fa=1) (the shift malfunction is occurring) (step S51: NO), the ECU 70 returns to step S51.

If it is determined in step S51 that the malfunction flag Fa is reset (Fa=0) (the shift malfunction is not occurring) (step S51: YES), the ECU 70 enters step S52.

In step S52, the ECU 70 determines whether or not the shift actuator 65 is being driven to move the reverse gate 33. In addition to a case where the shift actuator 65 is being driven based on an operation of the accelerator operator 13 or 14, cases where the shift actuator 65 is being driven also include a case where the shift actuator 65 is being driven by a command in terms of control different from an operation of the accelerator operator 13 or 14. If it is determined that the shift actuator 65 is not being driven (step S52: NO), the ECU 70 returns to step S51.

If in step S52, it is determined that the shift actuator 65 is being driven (step S52: YES), the ECU 70 determines whether or not an output value Vs of the shift position sensor 68 has changed within a predetermined time T2 (step S53).

If it is determined that the output value Vs of the shift position sensor 68 has changed within the predetermined time T2 (step S53: YES), the ECU 70 enters step S54. In step S54, the ECU 70 determines whether or not a change amount per unit time of the output value Vs of the shift position sensor 68 is not more than a predetermined value γ1. The change amount per unit time of the output value Vs of the shift position sensor 68 corresponds to a movement amount of the reverse gate 33 per unit time.

If it is determined that the amount of change per unit time of the output value Vs of the shift position sensor 68 is greater than the predetermined value γ1 (step S54: NO), the ECU 70 enters step S55. In step S55, the ECU 70 determines, based on the output value Vs of the shift position sensor 68, whether or not a rotation direction of the shift actuator 65 is the reverse of a rotation direction (commanded rotation direction) commanded by the ECU 70. If the rotation direction of the shift actuator 65 is the same direction as the commanded rotation direction (step S55: NO), the ECU 70 returns to step S51.

If in step S53, it is determined that the output value Vs of the shift position sensor 68 did not change within the predetermined time T2 (step S53: NO), the ECU 70 judges that a movement error has occurred and enters step S56. Also, if in step S54, it is determined that the change amount per unit time of the output value Vs of the shift position sensor 68 is not more than the predetermined value γ1 (step S54: YES), the ECU 70 judges that a movement error has occurred and enters step S56. Also, if in step S55, it is determined that the rotation direction of the shift actuator 65 is the reverse of the commanded rotational direction (step S55: YES), the ECU 70 judges that a movement error has occurred and enters step S56.

In step S56, the ECU 70 stops the movement of the reverse gate 33. Also, that the movement error has occurred is made to be displayed on the display 9 by the ECU 70 (step S57). Further, the ECU 70 prohibits movement of the reverse gate 33, other than that by the movement error process in the ordinary shift control process, etc., until the power of the ECU 70 is turned off (step S58).

Thereafter, the ECU 70 performs the movement error process. Specifically, the ECU 70 determines, based on the commanded rotation direction of the shift actuator 65, whether or not a commanded movement direction for the reverse gate 33 is a direction directed toward the forward drive position (step S59). If the shift position is switched from the reverse drive position or the neutral position to the forward drive position or if the shift position is switched from the reverse drive position to the neutral position, the commanded movement direction for the reverse gate 33 is a direction directed toward the forward drive position.

If the commanded movement direction for the reverse gate 33 is determined to be a direction directed toward the forward drive position (step S59: YES), the ECU 70 controls the shift actuator 65 to move the reverse gate 33 to the reverse drive position (step S60). The reverse gate 33 is thus moved in a direction opposite to the commanded movement direction at the point of occurrence of the movement error. If in this process, the engine 3 is in the stopped state, the ECU 70 decreases the electric current supplied to the shift actuator 65 with respect to that supplied during ordinary shift control to make the movement speed of the reverse gate 33 slower than the movement speed of the reverse gate 33 during the ordinary shift control. Thereafter, the ECU 70 ends the movement error monitoring process.

If in step S59, the commanded movement direction for the reverse gate 33 is determined not to be a direction directed toward the forward drive position (step S59: NO), the ECU 70 controls the shift actuator 65 to move the reverse gate 33 to the forward drive position (step S61). That is, if the commanded movement direction of the reverse gate 33 is a direction directed toward the reverse drive position, the ECU 70 makes the reverse gate 33 move to the forward drive position. The reverse gate 33 is thus moved in a direction opposite to the commanded movement direction at the point of occurrence of the movement error. If in this process, the engine 3 is in the stopped state, the ECU 70 decreases the electric current supplied to the shift actuator 65 with respect to that supplied during ordinary shift control to make the movement speed of the reverse gate 33 slower than the movement speed of the reverse gate 33 during the ordinary shift control. Thereafter, the ECU 70 ends the movement error monitoring process.

With the movement error monitoring process shown in FIG. 15A and FIG. 15B, if when the shift actuator 65 is being driven, the movement of the reverse gate 33 is obstructed, for example, by an obstacle, it is judged that the movement error has occurred. Then by the movement error process, the reverse gate 33 is moved in the direction opposite to the commanded movement direction at the point of movement error occurrence. The obstacle is thus released and resolution of the movement error is thus enabled.

With the movement error monitoring process shown in FIG. 15A and FIG. 15B, whether or not the movement error has occurred is judged accurately based on the movement state of the reverse gate 33.

With the present preferred embodiment, when the ECU 70 judges that the movement error has occurred, it makes the display 9 display that the movement error has occurred (step S57). That the movement error has occurred is thus notified to the operator.

With the present preferred embodiment, after judging that the movement error has occurred (after starting the movement error process), the ECU 70 prohibits the movement of the reverse gate 33, other than that by the movement error process in the ordinary shift control process, etc., until the power of the ECU 70 is turned off (step S58). Shift control other than that of the movement error process is thus disabled when the reverse gate 33 is being moved by the movement error process. Interference of the movement error process by the shift control other than that of the movement error process is thus avoided and the reverse gate 33 is prevented from being moved in the direction opposite to the movement direction under the movement error process.

In the present preferred embodiment, the movement error judgment is not performed when the shift malfunction is occurring. An uncertain movement error judgment is thus avoided.

In step S60, the ECU 70 moves the reverse gate 33 to the reverse drive position. However, the ECU 70 may instead move the reverse gate 33 to the position immediately before execution of the shift control during which the movement error occurred. Also in step S61, the ECU 70 may similarly move the reverse gate 33 to the position immediately before execution of the shift control during which the movement error occurred. The obstacle is released in this case as well to enable resolution of the movement error.

With the movement error monitoring process shown in FIG. 15A and FIG. 15B, the ECU 70 judges whether or not the movement error is occurring based on the output value Vs of the shift position sensor 68 (see steps S53, S54, and S55). However, the ECU 70 may judge whether or not the movement error is occurring based instead on an electric current (hereinafter referred to as the "shift actuator current Is") flowing through the shift actuator 65. In this case, the jet propelled watercraft 1 is provided with an electric current sensor 75 (indicated by alternate long and two short dashes lines in FIG. 9) configured to detect the shift actuator current Is. The electric current sensor 75 is connected to the ECU 70.

In this case, as indicated by broken lines in FIG. 15A, if it is determined in step S52 that the shift actuator 65 is being driven (step S52: YES), the ECU 70 enters step S62. In step S62, the ECU 70 determines whether or not the shift actuator current Is detected by the current sensor 75 is not less than a predetermined value γ2. If the shift actuator current Is is less than the predetermined value γ2 (step S62: NO), the ECU 70 returns to step S51. If the shift actuator current Is is not less than the predetermined value γ2 (step S62: YES), the ECU 70 judges that the movement error is occurring and enters step S56.

The shift actuator current Is corresponds to a load applied to the shift actuator 65. Therefore, when the load on the shift actuator 65 increases due to an obstacle, etc., it is judged that the movement error is occurring.

Whether or not the movement error is occurring may be performed by comparing, for example, a time required for the reverse gate 33 to move from a certain shift position to another shift position with a time set in advance. Whether or not the movement error is occurring may be performed by comparing, for example, the target shift position and the reverse gate position detected by the shift position sensor 68.

Figure 16A:
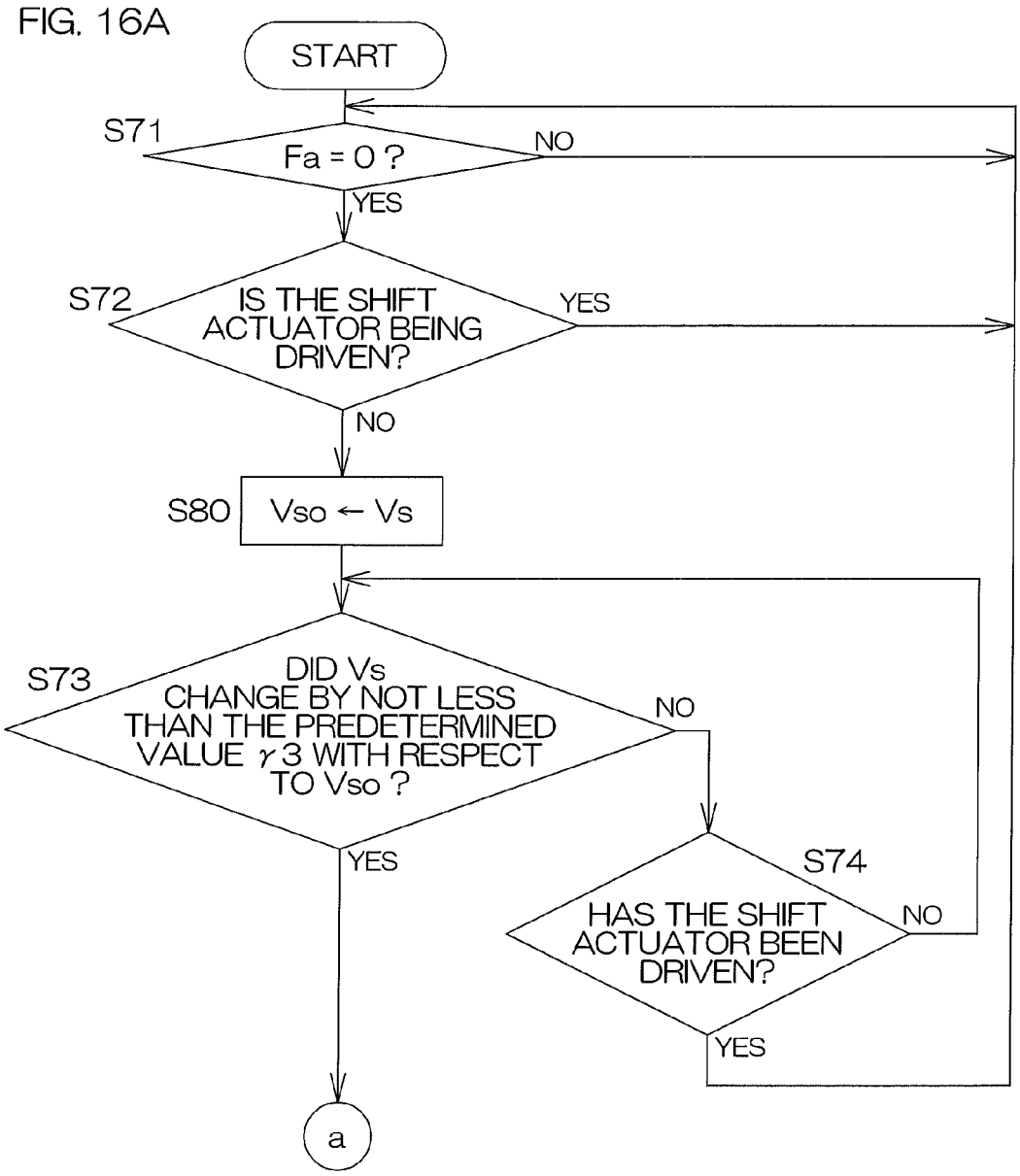
FIG. 16A is a flowchart of a portion of a procedure of an example of a keep error monitoring process performed by the ECU.
Figure 16B:
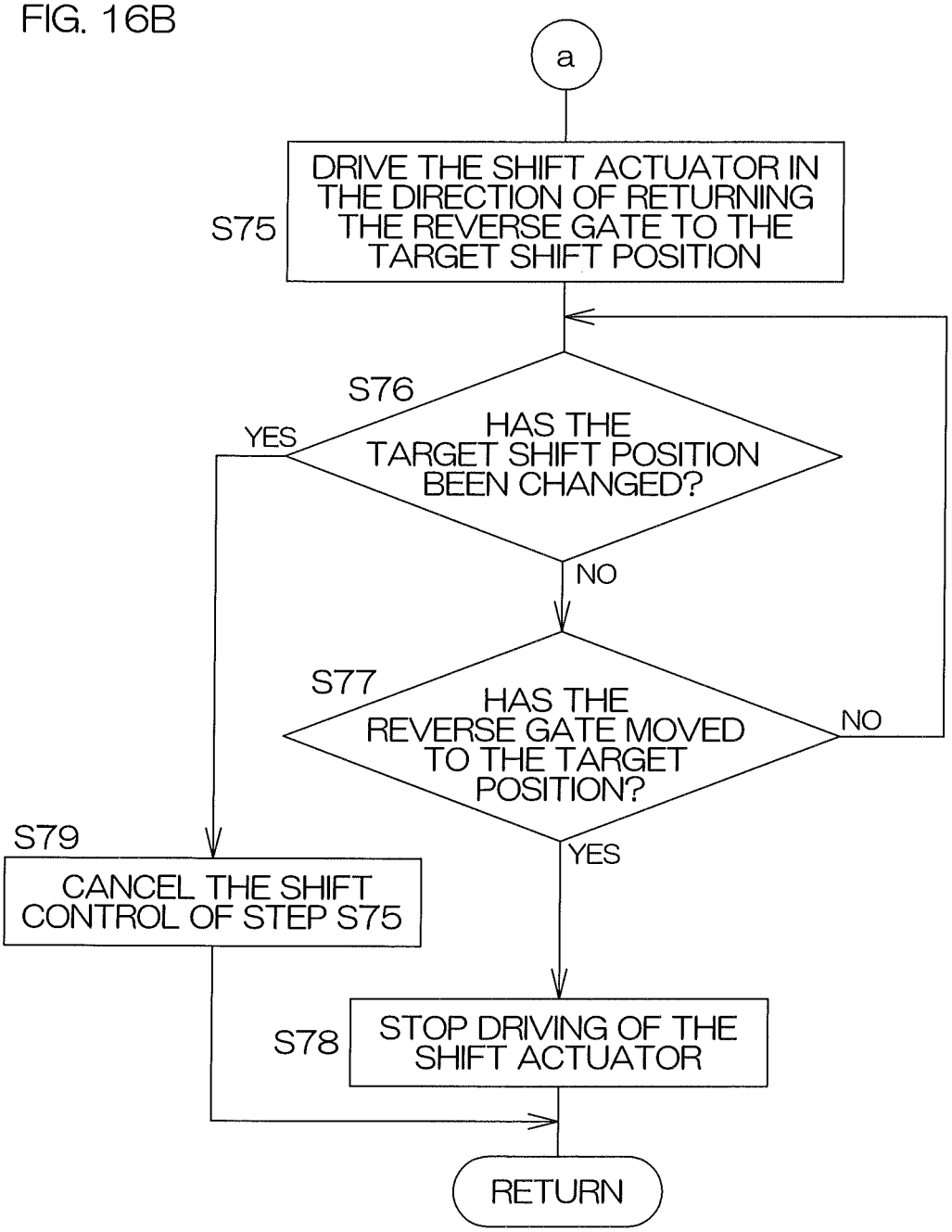
FIG. 16B is a flowchart of a portion of the procedure of the example of the keep error monitoring process performed by the ECU.

FIG. 16A and FIG. 16B are flowcharts of a procedure of an example of a keep error monitoring process performed by the ECU 70. A "keep error" refers to a state where the revere gate 33 has deviated from the target shift position due to an external force, etc., when the shift actuator 65 is not being driven to move the reverse gate 33. The keep error monitoring process is a process of monitoring whether or not the keep error has occurred and performing a keep error process when the keep error has occurred. The keep error monitoring process is executed only when the engine 3 is being driven.

The ECU 70 determines whether or not the malfunction flag Fa is reset (Fa=0) (step S71). If the malfunction flag Fa is set (Fa=1) (the shift malfunction is occurring) (step S71: NO), the ECU 70 returns to step S71.

If it is determined in step S71 that the malfunction flag Fa is reset (Fa=0) (the shift malfunction is not occurring) (step S71: YES), the ECU 70 enters step S72.

In step S72, the ECU 70 determines whether or not the shift actuator 65 is being driven to move the reverse gate 33. If it is determined that the shift actuator 65 is being driven (step S72: YES), the ECU 70 returns to step S71.

If in step S72, it is determined that the shift actuator 65 is not being driven (step S72: NO), the ECU 70 enters step S80. In step S80, the ECU 70 stores the output value Vs of the shift position sensor 68 at that point as an error judgment reference value Vso in the storage or memory 81. Thereafter, the ECU 70 determines whether or not the output value Vs of the shift position sensor 68 has changed by not less than a predetermined value γ3 with respect to the error judgment reference value Vso (step S73). The predetermined value γ3 is set to a value greater than a range of clearance of the reverse gate moving mechanism 64. If it is determined that the output value Vs of the shift position sensor 68 has not changed by not less than the predetermined value γ3 with respect to the error judgment reference value Vso (step S73: NO), the ECU 70 determines whether or not the shift actuator 65 has been driven to move the reverse gate 33 (step S74). If the shift actuator 65 is not being driven (step S74: NO), the ECU 70 returns to step S73 is performed. That is, if the shift actuator 65 is not being driven, the process of step S73 and the process of step S74 are repeated.

If in step S74, it is determined that the shift actuator 65 has been driven (step S74: YES), the ECU 70 returns to step S71. If in step S73, it is determined that the output value Vs of the shift position sensor 68 has changed by not less than the predetermined value γ3 with respect to the error judgment reference value Vso (step S73: YES), the ECU 70 judges that the keep error has occurred. In this case, the ECU 70 performs the keep error process without making the display 9 display that the keep error has occurred.

Specifically, the ECU 70 drives the shift actuator 65 in a direction in which the reverse gate 33 is returned to the target shift position (step S75). In driving the shift actuator 65, the ECU 70 may limit the rotational speed of the engine 3 to not more than a predetermined limit speed so that the reverse gate 33 is moved easily to the target shift position. Thereafter, the ECU 70 determines whether or not the target shift position has been changed by the ordinary shift control process (step S76). If it is determined that the target shift position has not been changed (step S76: NO), the ECU 70 determines whether or not the reverse gate 33 has moved to the target shift position (step S77). If the reverse gate 33 has not moved to the target shift position, the ECU 70 returns to step S76.

If the reverse gate 33 has moved to the target shift position without the target shift position being changed, an affirmative judgment is made in step S77 and therefore the ECU 70 stops the driving of the shift actuator 65 (step S78). The reverse gate 33 is thus returned to the target shift position. Thereafter, the ECU 70 returns to step S71.

If in step S76 it is determined that the target shift position has been changed during moving of the reverse gate 33 (step S76: YES), the ECU 70 cancels the keep error process (step S79). The ECU 70 then returns to step S71. If the keep error process is canceled in step S79, the ordinary shift control process is executed with priority and therefore the reverse gate 33 is moved to the target shift position after the change.

By the keep error monitoring process shown in FIG. 16A and FIG. 16B, it is judged that the keep error has occurred if the reverse gate 33 is moved by an external force, etc., and the reverse gate 33 deviates from the target shift position when the shift actuator 65 is not being driven. Then by the keep error process, the reverse gate 33 is moved to the target shift position. The reverse gate 33 is thus returned to the target shift position when the keep error has occurred.

Also, if the target shift position is changed while the keep error process is being performed, the keep error process is cancelled and the ordinary shift control process is performed with priority. The reverse gate 33 is thus moved promptly to the target shift position after the change.

With the present preferred embodiment, when the ECU 70 judges that the keep error has occurred, the keep error process is performed without it being displayed on the display 9 that the keep error has occurred. A positional deviation of the reverse gate 33 due to an external force, etc., is recovered automatically and therefore notification thereof as an error to the operator is of no benefit. Therefore in such a case, it is more appropriate not to perform display of error occurrence.

With the present preferred embodiment, the keep error judgment is not performed when the shift malfunction is occurring. An uncertain keep error judgment is thus avoided.

With the keep error monitoring process shown in FIGS. 16A, and 16B, the ECU 70 judges whether or not the keep error is occurring based on whether or not the output value Vs of the shift position sensor 68 has changed by not less than the predetermined value γ3 with respect to the error judgment reference value Vso (step S73). However, the ECU 70 may instead judge whether or not the keep error is occurring by comparing the reverse gate position detected by the shift position sensor 68 and the target shift position. Specifically, it may be judged that the keep error is occurring if the difference between the reverse gate position detected by the shift position sensor 68 and the target shift position is not less than a predetermined value.

With the keep error monitoring process shown in FIGS. 16A, and 16B, if it is determined in step S72 that the shift actuator 65 is not being driven, the ECU 70 stores the output value Vs of the shift position sensor 68 at that point as the error judgment reference value Vso. However, the error judgment reference value Vso may instead be set as follows. That is, at the start of the keep error monitoring process, the ECU 70 stores the output value Vs of the shift position sensor 68 as the error judgment reference value Vso in the storage or memory 81. The ECU 70 then renews the error judgment reference value Vso so that the error judgment reference value Vso is equal to the output value Vs of the shift position sensor 68 when the shift actuator 65 is being driven.

In this case, step S80 and step S74 in FIG. 16A are omitted. That is, if it is determined in step S72 that the shift actuator 65 is not being driven (step S72: NO), the ECU 70 enters step S73. If it is determined in step S73 that the output value Vs of the shift position sensor 68 has not changed by not less than the predetermined value γ3 with respect to the error judgment reference value Vso (step S73: NO), the ECU 70 returns to step S71.

By the movement error monitoring process shown in FIG. 15A and FIG. 15B and the keep error monitoring process shown in FIG. 16A and FIG. 16B, it is judged that an error has occurred if the reverse gate position differs from the control position. Appropriate control is thus performed when the reverse gate position differs from the control position.

Although a preferred embodiment of the present invention has been described above, the present invention may be implemented in yet other preferred embodiments.

For example, with the preferred embodiment described above, in regard to the process of FIG. 11, the first threshold α1 and the second threshold α2 are preferably set so that the first throttle opening degree Θ1 corresponding to the first threshold α1 and the second throttle opening degree Θ2 corresponding to the second threshold α2 are of equal value (Θa). However, the first threshold α1 and the second threshold α2 may be set so that the first throttle opening degree Θ1 corresponding to the first threshold α1 and the second throttle opening degree Θ2 corresponding to the second threshold α2 take on different values. In this case, the engine speed that serves as a basis for determining operation differs between the first accelerator operator 13 and the second accelerator operator 14. The operations of the first accelerator operator 13 and the second accelerator operator 14 is thus determined from a standpoint of the respective magnitudes of the forward drive propulsive force and the reverse drive propulsive force generated when the engine 3 is started. The start prohibition of the engine 3 is thus controlled even more appropriately.

Figure 10B:
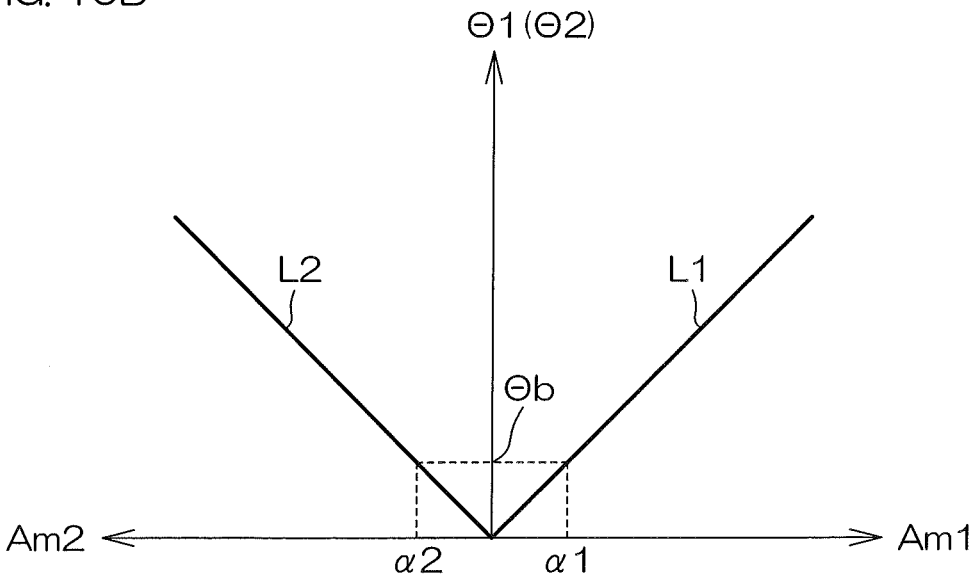
FIG. 10B is a characteristics diagram of another setting example of the throttle opening degree with respect to the accelerator operation amount.

Also, with the preferred embodiments described above, the rate of change of the second throttle opening degree Θ2 with respect to the second accelerator operation amount Am2 preferably is set to be smaller than the rate of change of the first throttle opening degree Θ1 with respect to the first accelerator operation amount Am1 as shown in FIG. 10A. However, as shown in FIG. 10B, the rate of change of the second throttle opening degree Θ2 with respect to the second accelerator operation amount Am2 (slope of the straight line L2 in FIG. 10B) may be set to be equal to the rate of change of the first throttle opening degree Θ1 with respect to the first accelerator operation amount Am1 (slope of the straight line L1 in FIG. 10B). In this case, the first threshold α1 and the second threshold α2 may be set to the same value as shown in FIG. 10B. When the first threshold α1 and the second threshold α2 are set to the same value, the first throttle opening degree Θ1 corresponding to the first threshold α1 and the second throttle opening degree Θ2 corresponding to the second threshold α2 take on the same value (Θb).

With the preferred embodiments described above, in the ordinary travel mode, the ECU 70 performs the ordinary engine speed control process and the ordinary shift control process in accordance with the operation amount of the first accelerator operator 13, the operation amount of the second accelerator operator (reverse gate operator) 14, and the engine speed. However, in the ordinary travel mode, the ECU 70 may control the engine speed in accordance with the operation of the first accelerator operator 13 and perform shift control in accordance with the operation of the second accelerator operator 14. That is, the second accelerator operator 14 may be used just to switch the shift position.

Although with the preferred embodiments described above, the second accelerator operator 14 preferably is a lever type, it may instead be of a grip type or may be a toggle switch or a button switch. Also, although with the preferred embodiments described above, the first accelerator operator 13 preferably is a lever type, it may instead be of a grip type.

If the second accelerator operator 14 is a switch, such as a toggle switch or button switch, etc., the second accelerator operator 14 constitutes a reverse gate operation detector that outputs a reverse gate position command signal in accordance with the operation of the second accelerator operator 14. In this case, the ECU 70 determines, in step S3 of FIG. 11, that the second accelerator operator 14 is being operated when, for example, the reverse gate position command signal is being output by the second accelerator operator 14. That is, whether or not the second accelerator operator 14 is being operated is determined based on whether or not the reverse gate position command signal is output. The starting of the engine 3 is thus prohibited under circumstances where there is a possibility for the reverse gate position to be changed in response to the position command signal. The starting of the engine 3 is thus prohibited appropriately.

With the preferred embodiments described above, the shift position of the reverse gate 33 preferably is detected by the shift position sensor 68 that detects the rotation angle of the shift arm 66. However, the shift position may be detected by a plurality of limit switches.

Although with the preferred embodiments described above, the shift actuator 65 preferably is an electric motor, a hydraulic actuator may be used instead.

Although with the preferred embodiments described above, the case where the prime mover is the engine 3 was described, the prime mover may be an electric motor instead. In this case, the electric motor is started up as the prime mover in step S4 of FIG. 11. In step S5 of FIG. 11, it is judged whether or not the electric motor has been started up. In step S11 of each of FIG. 12 and FIG. 13, it is determined whether or not the electric motor has stopped. In step S13 of each of FIG. 12 and FIG. 13, it is determined whether or not the electric motor has been restarted.

Although with the preferred embodiments described above, the engine 3, the shift actuator 65, the display 9, etc., preferably are controlled by a single ECU 70, these may be controlled by a plurality of ECUs instead.

Also, although with the preferred embodiments described above, the case where the jet propelled watercraft preferably is a personal watercraft was described, the present invention may be applied to a jet propelled watercraft of another form, such as a jet boat, a sport boat, etc.

The present application corresponds to Japanese Patent Application No. 2014-162717 filed on Aug. 8, 2014 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a body;

a prime mover;

a jet pump driven by the prime mover and jetting water from a jet port;

a reverse gate changing a direction of the jet flow jetted from the jet pump;

a shift actuator switching a position of the reverse gate among a plurality of shift positions including a forward drive position, at which the direction of the jet flow is toward the rear of the body, a reverse drive position, at which the direction of the jet flow is toward the front of the body, and a predetermined neutral position between the forward and reverse drive positions;

a reverse gate position detector detecting the position of the reverse gate; and a controller configured or programmed to execute a shift control of setting a target shift position of the reverse gate and controlling the shift actuator to move the reverse gate to the target shift position and execute an error judgment of judging that an error has occurred when the position detected by the reverse gate position detector differs from a control position.

2. The jet propelled watercraft according to claim 1, wherein the controller is configured or programmed to execute a movement error process of controlling the shift actuator to stop the movement of the reverse gate by the shift control and move the reverse gate in a direction opposite to a direction of movement of the reverse gate before stoppage when the controller judges that the error has occurred during driving of the shift actuator by the shift control to move the reverse gate.

3. The jet propelled watercraft according to claim 1, wherein the controller is configured or programmed to execute a movement error process of controlling the shift actuator to stop the movement of the reverse gate by the shift control and move the reverse gate to a position immediately before being moved by the shift control when the controller judges that the error has occurred during driving of the shift actuator by the shift control to move the reverse gate.

4. The jet propelled watercraft according to claim 2, wherein the controller is configured or programmed to judge whether or not the error has occurred based on a movement amount of the reverse gate per unit time during driving of the shift actuator by the shift control to move the reverse gate.

5. The jet propelled watercraft according to claim 2, wherein the shift actuator is an electric shift actuator; and the controller is configured or programmed to judge whether or not the error has occurred based on an electric current flowing through the electric actuator during driving of the electric actuator by the shift control to move the reverse gate.

6. The jet propelled watercraft according to claim 2, wherein the controller is configured or programmed so that after the movement error process has been started, movement of the reverse gate by the shift control is prohibited until a power supply of the controller is turned off.

7. The jet propelled watercraft according to claim 2, further comprising:

a display; wherein the controller is configured or programmed to make error occurrence be displayed on the display when the controller judges that the error has occurred during driving of the shift actuator by the shift control to move the reverse gate.

8. The jet propelled watercraft according to claim 1, further comprising:

a storage storing a most recent target shift position; wherein the controller is configured or programmed to judge that the error has occurred if, when the shift actuator is not being driven by the shift control to move the reverse gate, the position detected by the reverse gate position detector differs from the target shift position stored in the storage.

9. The jet propelled watercraft according to claim 8, wherein the controller is configured or programmed to execute a keep error process of controlling the shift actuator to move the reverse gate to the target shift position stored in the storage if the controller judges that the error has occurred when the shift actuator is not being driven by the shift control to move the reverse gate.

10. The jet propelled watercraft according to claim 8, further comprising:

a display; wherein the controller is configured or programmed so as not to make error occurrence be displayed on the display if the controller judges that the error has occurred when the shift actuator is not being driven by the shift control to move the reverse gate.

11. The jet propelled watercraft according to claim 9, wherein the controller is configured or programmed so that if the target shift position is changed while the keep error process is being executed, the controller cancels the keep error process and causes the reverse gate to be moved by the shift control to the target shift position after the change.

12. The jet propelled watercraft according to claim 1, wherein the controller is configured or programmed to execute a malfunction determination of determining whether or not a malfunction has occurred in the reverse gate position detector or the shift actuator and to perform the error judgment when the controller determines that a malfunction is not occurring in the reverse gate position detector or the shift actuator.

13. The jet propelled watercraft according to claim 1, wherein the controller is configured or programmed to execute a malfunction determination of determining whether or not a malfunction has occurred in the reverse gate position detector or the shift actuator and so as not to perform the error judgment when the controller determines that a malfunction has occurred in the reverse gate position detector or the shift actuator.

14. The jet propelled watercraft according to claim 13, wherein the controller is configured or programmed to control the shift actuator to move the reverse gate to the forward drive position when the controller determines that a malfunction has occurred in the reverse gate position detector.

15. The jet propelled watercraft according to claim 3, wherein the controller is configured or programmed to judge whether or not the error has occurred based on a movement amount of the reverse gate per unit time during driving of the shift actuator by the shift control to move the reverse gate.

16. The jet propelled watercraft according to claim 3, wherein the shift actuator is an electric shift actuator; and the controller is configured or programmed to judge whether or not the error has occurred based on an electric current flowing through the electric actuator during driving of the electric actuator by the shift control to move the reverse gate.

17. The jet propelled watercraft according to claim 3, wherein the controller is configured or programmed so that after the movement error process has been started, movement of the reverse gate by the shift control is prohibited until a power supply of the controller is turned off.

18. The jet propelled watercraft according to claim 3, further comprising:

a display; wherein the controller is configured or programmed to make error occurrence be displayed on the display when the controller judges that the error has occurred during driving of the shift actuator by the shift control to move the reverse gate.

* * * * *